US008100778B2

(12) United States Patent
Willis

(10) Patent No.: US 8,100,778 B2
(45) Date of Patent: Jan. 24, 2012

(54) GOLF TRAINING DEVICE

(76) Inventor: Stuart Willis, Hertfordshire (GB)

( * ) Notice: Subject to any disclaimer, the term of this patent is extended or adjusted under 35 U.S.C. 154(b) by 0 days.

(21) Appl. No.: 12/737,345

(22) PCT Filed: Jul. 2, 2009

(86) PCT No.: PCT/GB2009/001662

§ 371 (c)(1),
(2), (4) Date: Dec. 30, 2010

(87) PCT Pub. No.: WO2010/001129

PCT Pub. Date: Jan. 7, 2010

(65) Prior Publication Data

US 2011/0098124 A1 Apr. 28, 2011

Related U.S. Application Data

(60) Provisional application No. 61/078,645, filed on Jul. 7, 2008, provisional application No. 61/151,074, filed on Feb. 9, 2009.

(30) Foreign Application Priority Data

Jul. 4, 2008 (GB) ..... 0812336.6

(51) Int. Cl.
*A63B 69/36* (2006.01)

(52) U.S. Cl. ..... 473/218; 473/257

(58) Field of Classification Search ..... 473/218, 473/219, 231, 257, 261, 262, 265, 266, 270, 473/272, 273, 278, 279, 422
See application file for complete search history.

(56) References Cited

U.S. PATENT DOCUMENTS

| | | | | |
|---|---|---|---|---|
| 2,169,407 A | | 8/1939 | Crowley | |
| 2,457,351 A | | 12/1948 | Crowley | |
| 3,753,563 A | | 8/1973 | Previte | |
| 4,732,390 A | * | 3/1988 | McCollum | 473/264 |
| 4,927,152 A | * | 5/1990 | Graham | 473/265 |
| 5,014,994 A | | 5/1991 | Peters | |

(Continued)

FOREIGN PATENT DOCUMENTS

GB 2349828 A 11/2000

(Continued)

OTHER PUBLICATIONS

International Searching Authority; International Search Report of the International Searching Authority; International Application No. PCT/GB2009/001662; Patent Cooperation Treaty; pp. 1-4; publisher European Patent Office; Published HV Rijswijk, Netherlands; copyright and mailing date Nov. 18, 2009 (4 pages).

(Continued)

*Primary Examiner* — Nini Legesse
(74) *Attorney, Agent, or Firm* — J. Bennett Mullinax, LLC

(57) ABSTRACT

The present invention relates to a golf training device and method of use thereof. Specifically, the training device seeks to correct faults in a golfer's swing. The device enables correct alignment and correct swing path to be practised simultaneously while practising both shots or drills requiring a "square" alignment or shots or drills requiring an "open" or "closed" alignment. Furthermore, the device, and method of use thereof, can be used by all sizes of golfer, using all types and sizes of clubs, practising all types of shot.

20 Claims, 15 Drawing Sheets

U.S. PATENT DOCUMENTS

| | | | |
|---|---|---|---|
| 5,180,168 | A | 1/1993 | Balestrieri |
| 5,527,037 | A | 6/1996 | Matsumoto |
| 6,939,242 | B1 | 9/2005 | Battersby |
| 7,431,661 | B1 | 10/2008 | Cailey |
| 2006/0040760 | A1 | 2/2006 | Du Preez |
| 2006/0240902 | A1 | 10/2006 | Jordan |

FOREIGN PATENT DOCUMENTS

| | | | |
|---|---|---|---|
| GB | 2397773 | | 8/2004 |
| GB | 2425263 | | 10/2006 |
| JP | 11137761 | A | 5/1999 |
| WO | WO 2006/056773 | | 6/2006 |

OTHER PUBLICATIONS

International Preliminary Examining Authority; International Prelilminary Report on Patentability; International Application No. PCT/GB2009/001662; Patent Cooperation Treaty; pp. 1-13; publisher European Patent Office; Published Munich, Germany; copyright and mailing date Nov. 10, 2010; (13 pages).

* cited by examiner

GOLF TRAINING DEVICE

CROSS REFERENCE TO RELATED APPLICATIONS

This application claims priority from previously filed PCT application number PCT/GB2009/001662 filed on Jul. 2, 2009 which claims priority from UK application number 0812336.6 filed Jul. 4, 2008, U.S. application No. 61/078,645 filed Jul. 7, 2008, and U.S. application No. 61/151,074 filed Feb. 9, 2009. The entire contents of PCT/GB2009/001662, UK 0812336.6, U.S. 61/078,645, and U.S. 61/151,074 are incorporated by reference herein in their entireties for all purposes.

STATEMENT REGARDING FEDERALLY SPONSORED RESEARCH OR DEVELOPMENT

N/A

BACKGROUND OF THE INVENTION

The present invention relates to a golf training device. Specifically, the training device can be used in assisting the correction of faults in a golfer's swing.

In the game of golf, a number of faults can exist with a golfer's swing. The three main faults relate to an incorrect swing path during the execution of a swing, an incorrect stance alignment of the golfer's feet relative to the ball during the execution of a swing and an incorrect club face alignment relative to the ball during the execution of a swing. It is crucial that these three areas are harmonised i.e. that a correct swing path and a correct alignment (of both stance and club face) are practiced together.

The term "stance alignment" describes how an imaginary line connecting a golfer's feet is angled relative to the swing path. For a player executing standard basic shots, square alignment of the player's feet with respect to the ball is required and an "in to square to in" swing path is required. However, it is sometimes required to have an "open" or "closed" stance, such as when chipping or shaping a shot (fades and draws), and the correlation between stance alignment and swing path, although not square, is equally important.

For an "open" stance, the golfer is angled relative to the swing path such that the distance between the golfer's feet and the swing path is larger at the end of the swing path rather than at the beginning i.e. the golfer's chest is angled slightly towards the target. For a "closed" stance, the golfer is angled relative to the swing path such that the distance between the golfer's feet and the swing path is smaller at the end of the swing path rather than at the beginning i.e. the golfer's chest is angled slightly away from the target. Furthermore, the swing path and alignment will vary depending on the size and type of the golf club used and the size of the golfer.

When performing a "chip" shot, a more "open" stance is adopted such that the angle between the golfer's feet and the swing path is between 10 to 30 degrees. This provides room for the golfer's arms to swing freely and release the club towards the hole. When performing a chip shot, the golfer aims to hit down on the ball.

A "fade" shot and a "draw" shot is where the ball is hit to the left but curves to the right and vice versa respectively. This is useful when attempting to get around an object that is in between the ball and the target and is achieved by giving the ball "spin" so that it curves in the air. In order to perform a "fade", the swing path and the golfer's feet are parallel and pointing towards the left hand side of the obstructing object (along the so-called "starting line" or "initial ball path line") whereas the face of the golf club is directed towards the target (facing along the so-called "target line"). Performing a golf swing in this arrangement causes the ball to spin in a clockwise direction and therefore curve to the right (for a right handed golfer). Likewise, in order to perform a "draw", the swing path and the golfer's feet are parallel and pointing towards the right hand side of the obstructing object (along the so-called "starting line" or "initial ball path line") and the face of the golf club is directed towards the target (facing along the so-called "target line". Performing a golf swing in this arrangement causes the ball to spin in an anticlockwise direction and therefore curve to the left (for a right handed golfer).

There are a number of examples of practice drills that are performed by golfers in order to improve their golf swings. One such example of a drill performed in order to improve putting technique is the "tick-tock" method. In this drill, the golfer seeks to give the putting stroke "balance" either side of where the ball is, so that the backstroke and through stroke are in tune with one another. The drill involves the golfer swinging the putter back and forth between two objects placed approximately 9 inches (23 cm) either side of an imaginary ball position. Repeating this movement enables the golfer to get a feel for a more "balanced" putting stroke. The problem with performing this drill is that contact between the putter and the objects may result in damage to the putter.

Another drill seeks to improve a golfer's upper body action during the performance of a golf swing the so-called "anti reverse pivot drill". In this drill, the golfer adopts the normal address position. The leading foot is then drawn backwards until the toe is level with the heel of the back foot. Performing golf swings in this position enables the golfer to adopt a strong but passive leg action during the stroke and forces them to unwind their upper body.

Another drill seeks to improve the golfer's swing during the performance of a "draw" shot. In this drill, the golfer adopts a normal stance. The golfer's back foot is then drawn back away from the target line, so that the toe of the back foot is in line with the knee of the leading leg. The golfer then lines their shoulders up with the target. Practising a "draw" golf swing in this position enables the golfer to get a feel for the club working its way around the body, leading to a more effective "draw" swing.

Another drill seeks to improve the golfer's swing path during the performance of a "drive". In this drill, the golfer lines up a corridor of tees so as to define a correct swing path for a "drive" shot. The golfer then attempts to perform a correct swing path without making contact with any of the tees. When this is mastered, the golfer can make the corridor of tees narrower so as to fine-tune their swing path. This drill can also be used to practice other golf shots such as when using an "iron" or "putter" club, and the desired swing path as defined by the golf tees is altered accordingly.

Another drill seeks to cure a golf swing that results in a "slice". A "slice" is where an "out to square to in" swing path is adopted so that the golf club head does not hit the golf ball squarely. This results in the golf ball deviating to the right (for a right handed golfer) and is one of the most common faults in a golfer's swing. In this drill, the golfer adopts their usual stance. An object such as a box is then placed approximately two inches (5 cm) away from the toe of the golf club. Another golf club is placed on the ground next to the golfer's feet, pointing towards the target, so as to indicate correct stance alignment. The golfer then performs a golf swing. If an "out to square to in" swing path is performed (which would result in a "slice"), the golf club head will contact the box. Repetition of this drill forces a golfer to perform the correct "in to square to in" swing path and, therefore, avoid performing a "slice". The problem with performing this drill is that there is a danger that contact with the object will result in damage to the golf club or injury to the golfer.

Another drill seeks to ensure that a sufficient level of "extension" is achieved during the end half of a golf swing. If a golfer's arms are too close to his body during the performance of a golf swing, the movement of the club around the body is restricted resulting in a weak shot or one which is off target. In this drill, an object is placed along the desired swing path beyond the point at which the ball is struck at a desired position. If the golf club head makes contact with the object during the performance of a golf swing, the golfer knows that his arms are not too close to his body and, therefore, the movement of his golf club around his body is not being restricted—he is thus achieving a sufficient level of "extension". The problem with performing this drill is that contact between the golf club head and the object may cause damage to the golf club or harm to the golfer.

Another drill, the so-called "one piece takeaway" seeks to address problems during the backswing part of a golf swing. If the golfer's arms are maintained at an incorrect distance from his body during the back swing portion of his golf swing, the subsequent "forward" portion of the golf swing may not generate the desired level of power or accuracy in order to generate the desired shot. In this drill, an object is placed at a desired position on the rear portion of a golfers backswing. If the golf club head makes contact with the object during the performance of a backswing, the golfer knows that he is maintaining his arms at the correct distance from his body. The problem with performing this drill is that contact between the golf club head and the object may cause damage to the golf club or harm to the golfer.

A number of training aids on the market seek to address problems with swing path. However, no training aids are available that seek to correct swing path, stance alignment and club face alignment at the same time, which can be used with all types of club—from putter to drivers, which can also be used to practice chipping shots or be used to perform practice drills which require a more "open" or "closed" stance.

The "Slice Correction Trainer" (The Inside Approach, Inc.) comprises a foam-covered metal bar which sits above the golf ball and is contacted by a golf club head when an "out to square to in" swing path (a slice) is executed.

The "Smart Path"® (Smart Path Systems, Inc.) consists of a platform on which a golf ball is placed. Two lines of near-vertical plastic tubes define a desired swing path, and an incorrect swing path will result in the club head contacting them.

Neither of these products can be adjusted to accommodate different sized clubs or different sized players. Furthermore, neither product addresses the all-important correlation between swing path and alignment. In addition, neither product can be used for all types clubs i.e. from drivers to putters or for all types of shot i.e. straight shots, chip shots or shaping shots.

The "Slice Correction Trainer" (Inside Approach) has the added problem that it has little forgiveness when hit by the golf club head during the execution of a swing with an undesired swing path. This has the potential to cause damage to both the user and the golf club.

The "Smart Path"® (Smart Path Systems, Inc.) features a raised hitting surface, rather than operating off ground level. This changes the angle of the club and, therefore, the user cannot execute a true swing. In addition, the playing surface of the device is made of polypropylene and polycarbonate rather than grass, and so the strike is not realistic. Furthermore, the thick posts inhibit the execution of a natural swing.

GB 2425263 (WOMERSLEY) and U.S. Pat. No. 5,014,994 (PETERS) disclose combinations of club guiding arms and foot placement indicators, which may be telescoped.

GB 2397773 (HOURIHAN), U.S. Pat. No. 6,939,242 (BATTERSBY) and JP 11137761 (HITACHI) all disclose guide means in which the guide arms may be bent to a degree, which reflects the shot being practiced. HOURIHAN and HITACHI also show foot placement means.

However, none of the prior art enables correct alignment (of both stance and the club face) and correct swing path to be practiced together when executing chipping shots i.e. when a more "open" stance is required in which the position of the golfer is twisted relative to the swing path, or various practice drills which require either a more "open" or "closed" stance.

SUMMARY

The present invention seeks to provide a solution to the above technical problem by providing a training device that addresses both the correction of a swing path and the correction of alignment (of both stance and the club face) when executing chipping shots or drills which require the swing path and foot alignment to be non-parallel, and which can be used for all types and sizes of club and by all sizes of golfer.

According to a first aspect of the present invention there is provided a golf training device comprising:

a tail arm having first and second ends;

first and second swing path arms having extending from them contact means; and an alignment arm pivoted to said tail arm, that in-use indicates a position for the feet of a golfer relative to said first end of said tail arm during the performance of a golf swing, wherein the distance between said alignment arm and said first end of said tail arm is adjustable.

In use, the first and second swing path arms can be used to define desired swing paths (or determine deviation from desired swing paths) for a golf club head during a golf club swing. As is shown in more detail below, either the first, second or both the first and second swing path arms can be employed to achieve this. For example, with the second swing path arm attached to the tail arm and the first swing path arm aligned with the second swing path arm (more specifically, generally parallel with it), a desired swing path can be defined between the first and second swing path arms.

The contact means are used to determine deviation from a desired swing path. Preferably, the contact means comprise a plurality of bristles, which extend out from the swing path arm. In use, in certain embodiments when a golf club head deviates from a desired swing path (i.e. an undesired swing path is performed), the golf club head will contact the bristles and will provide sensory feedback. The golfer will be able to feel and/or hear the bristles making contact and so will know that an undesired swing path was performed. In other embodiments (for example when seeking to achieve a desired "extension"), contact of the golf club head with the contact means can be used to indicate that a desired swing path has been achieved. The advantage of using bristles is that there will be minimal damage to the golfer or golf club when contact is made.

In other uses as shown below, the first and/or second swing path arms can be employed to define other desired swing paths. In particular, see the arrangements shown in FIGS. 16-35.

Thus, preferably said first and/or second swing path arms in use defines a desired swing path of a golf club head during a golf swing. Preferably, the first and second swing path arms in use define between them a desired swing path.

In certain embodiments, the second swing path arm is mounted on or attached to the tail arm. In other preferred embodiments, the second swing path arm is attachable to and detachable from the tail arm. This can be particularly advantageous in allowing for a wide range of arrangements of the device for different training drills, and can allow for the convenient packing or storage of the device for example in a golf bag (see e.g. FIG. 35).

As is detailed above, the alignment arm is pivoted to and rotatable about the tail arm. Preferably, it is rotatable in a plane generally parallel with a plane defined by the tail arm and the second swing path arm when the second swing path arm is attached to the tail arm. Thus, in use, with the second swing path arm attached to the tail arm, the tail arm, the alignment arm and the second swing path arm can be generally co-planar.

The tail arm, second swing path arm and alignment arm can be generally viewed as extending perpendicular to a vertical axis.

Preferably, the alignment arm indicates an in-use position relative to the first and second swing path arms.

Preferably, the first and second swing path arms are flexible.

Preferably, the tail arm is telescopic.

Thus, in certain embodiments the present invention provides a golf training device comprising:

a first flexible swing path arm and a second flexible swing path arm having extending from them contact means and which, in use, define between them a desired swing path of a golf club head during a golf swing, the curvature of said first and second swing path arms being adjustable such that, in use, the curvature of said desire swing path can be adjusted;

a telescopic tail arm having first and second ends and extending at said first end from said second swing path arm; and an alignment arm extending from said second end of said telescopic tail arm, that indicates an in-use position for the feet of said golfer relative to said first and second flexible swing path arms during the performance of a golf swing;

said alignment arm being pivoted to said telescopic tail arm such that said alignment arm is rotatable about said second end of said telescopic tail arm.

Preferably, said first and second flexible swing path arms are malleable. More preferably they are malleable such that, in use, they can be moulded at ambient temperature to a desired curvature and will retain their shape until moulded to a different desired curvature. As detailed above, in use different clubs and different strokes will necessitate different curvatures—from no curvature to substantial curvature. When using the device to practice putting with a "straight method"-type of stroke, the flexible swing path arms can be shaped straight. Alternatively a "door method"-type of putting stroke may be practiced, in which case a slight curvature may be defined. Alternatively, a stroke with a driver may be practiced, in which case they may be moulded to have a more substantial curvature.

Preferably, the first and second flexible swing path arms are each comprised of a strip of plastic with a wire interior.

Preferably, the tail arm is calibrated. For example, it can be calibrated with distance measurements or markers, or position markers. For example, markings can be provided every centimeter or other unit distance along the length of the tail arm.

The tail arm and second swing path arm are arranged so as to define a general plane, and the alignment arm is preferably rotatable in this plane or on an axis generally perpendicular to this plane. Therefore, in use, the alignment of one foot is not independent of the alignment of the other foot.

Preferably, the alignment arm is linear.

Preferably, the tail arm is linear.

Preferably, the separation of the first and second swing path arms is adjustable. A wider separation of them allows for a greater tolerance of deviation from the desired swing path. This enables the device to be used by less experienced players to correct large errors in their swing path. A narrower separation of them leads to a lesser tolerance of deviation from the desired swing path. This enables the device to be set up according to the skill level of the user, e.g. for more experienced players to fine-tune their swing path.

Preferably, the alignment of the first swing path arm can be altered relative to the second swing path arm. For, example, in order to perform the drill to ensure sufficient "extension", the golfer can position the first swing path arm perpendicular to the second swing path arm at a desired position along the swing path beyond the position at which the ball is struck. Therefore, when performing the drill, the first swing path arm contact means will make contact with the golf club head when the correct movement of the golf club around the golfer's body is achieved during the performance of the practice golf swing. Likewise, in order to perform the "one piece takeaway" drill, the first swing path arm can be placed perpendicular to the second swing path arm at a position along the swing path before the ball is struck. As is shown in the attached Figures, a wide range of drills can be performed using a wide range of configurations of the device.

Preferably, the contact means on the second swing path arm is angled from the vertical. Preferably, the contact means on the first and second swing path arms are angled from the vertical. This is most important for golf swings using a "driver" or "iron" club, in which the club is not vertical when the club head is located between the first and second swing path arms (i.e. when it makes or would make contact with a ball).

Preferably, the angle of the contact means relative to the vertical is adjustable. Preferably, the angle of the contact means is adjustable relative to the plane defined by the tail arm and the second swing path arm. Preferably, the angle is adjustable between an in-use horizontal angle and n in-use vertical angle. Preferably the angle of the contact means relative to the vertical is calibrated.

Preferably, the length of the contact means on the second swing path arm is curved, being shorter towards the middle of the second swing path arm than at the ends. This is particularly useful is helping ensure that when practising golf swings with "drivers" and "irons" the contact means are contacted appropriately by the golf club—overly long contact means such as bristles may otherwise result in inappropriate contact when practising golf swings that require relatively large amounts of movement in an axis defined between the golfer and the first end of the tail arm or the second swing path arm.

In certain embodiments, the contact means comprise markings. Thus, in use, the markings can be used to allow a ball to be placed at a desired position along the length of the desired swing path, according to the type of club used. For example, when performing a practice golf swing using a "driver", the golfer adopts a stance so that the ball is approximately opposite the heel of their leading leg, i.e. the leg closest to a desired target. In contrast, when performing a shot using an "iron" or a "putter", the golfer adopts a stance so that the ball is opposite the middle of their body. In addition, these markings allow the "tick-tock" drill to be performed by swinging a putter head between two markings either side of an imaginary ball position. This avoids the problem of potential damage to the putter which can result from the traditional implementation of the drill in which objects are placed either side of the imaginary ball position and can be contacted by the putter.

Preferably, the alignment arm is movable along said tail arm between said first and second ends.

Preferably, the tail arm is telescopic.

Preferably, the alignment arm comprises a sheath portion which is capable of sheathing the tail arm such that, in use, the alignment arm can be slid along the length of the tail arm.

Preferably, at least one of the tail arm, sheath portion and alignment arm is calibrated. For example, they can be calibrated with distance measurements or markers, or position markers. For example, markings can be provided every centimeter or other unit distance along the length of the tail arm, sheath portion or alignment arm. Thus, a golfer can position the first end of the tail arm (or the second swing path arm) and the alignment arm at a chosen distance apart during the execution of a golf swing. This is particularly useful in assisting in correct positioning of feet relative to the swing path for different shots—a shot using a "driver" requires a greater distance between the feet and the swing path than a shot using a "putter". Similarly, taller and shorter golfers require a larger or smaller separation respectively of the second swing path arm and alignment arm. The device can be arranged with previously determined calibration values, e.g. a golfer of a certain height could know that when practicing with a specific club then a specific separation between the second swing path arm and the alignment arm should be set.

Preferably, the tail arm is pivotally attached to the second swing path arm. Thus, the second swing path arm can equally be pivotally attached to the tail arm. Thus, in use, the second swing path arm can rotate about the tail arm, for example about the first end of the tail arm. This is useful for using the device when practicing shaping shots (fades or draws). In order to hit a fade or draw, the device is set up as if the object blocking the path to the hole was not there i.e. with the alignment arm and swing path arms parallel and pointing towards the target. The golfer will know at what angle he should direct his shot in order to get past the object but also such that the curvature of the ball will be sufficient to direct the ball towards the target, and can angle the swing path arms and alignment arm accordingly. The tail arm will still be perpendicular to the target meaning that the golfer can use the tail arm to line up the face of the golf club in the correct way so as to achieve the desired spin.

In certain embodiments, the first end of the tail arm is attached to the second swing path arm via a swivel hinge.

Preferably, the tail arm comprises a circular plug which extends vertically and fits into a diaphragm hole situated in the second swing path arm. In certain embodiments, this is located at the first end of the tail arm. Thus, the first end of the tail arm can be pivotally attached to the second swing path arm. In other embodiments (as detailed below) the second swing path arm is attached to (or attachable to) the tail arm and movable along the length of the tail arm. Other attachment means will be readily apparent to one of ordinary skill in the art.

Preferably, calibration means are provided arranged to measure the angle defined between the tail arm and the second swing path arm. Thus, in use, a chosen angle can be employed between the tail arm and the second swing path arm according to the type of shot to be practiced. Preferably, the calibration means comprises an angle measure. More preferably, the angle measure can indicate the angle by way of a scale having numeric values (e.g. indicating values from 0 to 90 degrees or 0 to 135 degrees). Thus, a specific angle can be chosen.

Preferably, the second swing path arm is movable laterally relative to the tail arm in order to further allow a desired swing path to be defined. Thus, in use, the golfer can define the desired swing path and avoid hitting one of either the first end of the second swing path arm (the end more remote from a desired target) or the second end of the swing path arm (less remote from a desired target). For example, when performing a fade shot, the golfer can avoid hitting the first end of the second swing path arm by moving the second swing path arm in a direction towards the target. Alternatively, when performing a draw shot, the golfer can define the desired swing path and avoid hitting the second end of the second swing path arm by moving the second swing path arm in a direction away from the target.

Preferably, the second swing path arm defines a slot that is engageable with the tail arm to allow movement of the second swing path arm relative to the tail arm.

Preferably, the second swing path arm comprises calibration means so that, in use, a desired distance of lateral movement of the second swing path arm relative to the tail arm can be selected. Preferably, these calibration means comprise marking.

Preferably, at least one swing path arm comprises a handle. Thus the device and its component parts can be easily carried by the golfer.

Preferably, the device comprises at least one ball location indicator, said ball location indicator comprising a first end and a second end and extending at said first end from said first end of said tail arm such that, in use, the second end indicates the desired position along the swing path that a golf ball should be placed before the performance of a golf swing. Preferably, in use, the ball is positioned at a position indicated by the ball location indicator.

Preferably, the ball location indicator has a fixed length. Thus, the ball location indicator indicates the position the ball should be placed relative to the first end of said tail arm. Thus, the alignment arm indicates an in-use position for the feet relative to the ball location indicator.

In certain embodiments, the angle between the tail arm and the ball location indicator is fixed. Preferably, the ball location indicator extends in an axis defined by the tail arm.

In other embodiments, the angle between the tail arm and said ball location indicator is adjustable. Preferably, the ball location indicator is pivotable about the tail arm. For example, when performing a practice golf swing using a "driver", the golfer adopts a stance so that the ball is approximately opposite the heel of their leading leg, i.e. the leg closest to a desired target. In contrast, when performing a shot using an "iron" or a "putter", the golfer adopts a stance so that the ball is opposite the middle of their body. Thus, the ball location indicator can be used to indicate the precise position the ball should be placed along the swing path relative to the first and second swing path arms. Thus, the golfer can adjust the angle between the ball location indicator and the first or second swing path arms according to the type of practice golf swing to be performed.

Preferably, calibration means allow a desired angle between the ball location indicator and at least one of the first and second swing path arms to be selected.

Preferably, the ball location indicator is replaceable.

Preferably, the ball location indicator further comprises a golf club head alignment indicator which, in use, indicates the desired alignment of the golf club head relative to the golf ball during the performance of a golf swing. For example, when performing a straight shot, the golf club head should be square to the ball when contact is made with the ball during the performance of the golf swing. In contrast, when performing a fade shot or a draw shot, the club face should not be square but should be angled to the right or left of a desired target, respectively, in order to provide the desired level of spin.

Preferably, said golf club head alignment indicator comprises a slot, which is defined by said ball location indicator.

Preferably, the device comprises a target pointer which, in use, indicates the direction towards a desired target that the golf ball is to reach on performance of the desired golf swing. Preferably, the angle between the target pointer and the first and second swing path arms is adjustable. For example, when performing a straight shot, the target pointer will indicate that the desired target is in a direction directly along the swing path. However, when performing a fade shot, the target pointer will indicate that the desired target is in a direction slightly to the right of the direction of the swing path. In contrast, when performing a draw shot, the target pointer will indicate that the desired target is in a direction slightly to the left of the direction of the swing path. Thus, the golfer can adjust the angle between the first and second swing path arms and the target pointer according to the desired golf swing to be performed. Thus, in use, the golfer can begin to align the device by first adjusting the target pointer to indicate the direction of a desired target. The alignment of other features of the device such as the swing path arms, tail arm, ball location indicator, alignment arm can then be carried out relative to the target pointer according to calibration means on each feature. Thus, the golfer can ensure that the device is correctly aligned for the desired practice golf swing to be executed.

Preferably, the second end of the ball location indicator comprises the target pointer. Preferably, the target pointer extends from the second end of the ball location indicator. Preferably, the ball location indicator and the target pointer together form a T-shape or an L-shape.

Preferably, the angle between the ball location indicator and the target pointer is adjustable. For example, when performing a fade shot with a driver club, the target pointer should indicate a direction slightly to the right of the direction of the swing path and the ball location indicator should indicate that the ball should be placed approximately opposite to the heel of their leading leg. In contrast, when performing, for example, a draw shot with an iron club, the target pointer should indicate a direction slightly to the left of the direction of the swing path and the ball location indicator should indicate that the ball should be placed opposite to the middle of the golfer's body.

Preferably, calibration means allow a desired angle between the target pointer and ball location indicator to be selected. Thus, the golfer can select the desired angle between the ball location indicator and the target pointer accordingly to the type of golf swing to be performed and the type of club to be used.

Preferably, the device comprises attachment means.

Preferably, the attachment means comprises an at least one hole defined in at least one of the first swing path arm, the second swing path arm, the tail arm and the alignment arm. Thus, the device can be arranged precisely according to the desired swing path/alignment combination and will not deviate from this precise arrangement after, for example, being knocked by the golfer or blown by wind. Preferably, the at least one hole is dimensioned such that a peg (for example, a golf tee, more particularly the body portion of a golf tee comprising a body portion and a ball supporting portion) may be inserted through the at least one hole in order to attach the device to a surface such as grass.

Preferably, at least one of the first and second swing path arms, the tail arm and the alignment arm is shaped with a protrusion such as a wing extending from it. Preferably, the protrusion defines the at least one hole.

Preferably, the at least one hole is a diaphragm hole.

Preferably, the attachment means is for attachment to a driving range mat.

Preferably, at least one hole, more preferably at least one diaphragm hole, comprises a hole defined in the second swing path arm and dimensioned to allow the passage of a driving range tee. More preferably, the hole dimensioned to allow passage of a driving range tee is adapted to engage a driving range tee, for example by way of a friction fit.

Preferably, the alignment arm is calibrated. For example, it can be calibrated with distance measurements or markers, or position markers. For example, markings can be provided every centimeter or other unit distance along the length of the alignment arm. Thus, a golfer can position each of their feet at a chosen location along the length of the alignment arm during the execution of a golf swing. This is particularly useful in assisting in correct positioning of feet for different shots—a shot using a "driver" requires a greater distance between the feet than a shot using a "putter". In use, the golfer's feet are positioned either side of the tail arm i.e. the feet are typically not adjacent to the tail arm.

Preferably, the device comprises calibration means arranged to measure the angle defined between the alignment arm and the tail arm. Thus, a chosen angle can be employed between the alignment arm and the tail arm according to the desired shot to be executed. For example, when performing a "splash shot" (a chip shot out of a sand trap), a golfer usually adopts an "open" stance such that the swing path is directly pointing towards the target but the golfer's feet are angled at approximately 30 degrees to the left hand side of the target (for a right handed golfer). The calibration means allows a golfer to practice shots whilst ensuring that the desired angle of alignment is adopted.

Preferably, the second swing path arm is movable along the tail arm. Thus, in use, the ball can be kept centred between the two swing path arms when a certain separation of the two swing path arms is employed. Consider, for example, the device aligned so as to perform a certain practice golf swing using a driver. The separation of the two swing path arms and, therefore, the level of tolerance of an incorrect golf swing (i.e. deviation from a desired swing path), can be selected. If, for example, a driver with a 3 inch (7.6 cm) wide club head is used and a tolerance of 1 inch (2.5 cm) either side of the desired swing path is wanted, then the separation of the two swing path arms will be 5 inches, (12.7 cm) with the centre of the ball positioned exactly 2.5 inches (6.4 cm) from each swing path arm. If, for example, it is then desired to change the tolerance of an incorrect swing path to 2 inches (5.1 cm) either side of the desired swing path, then the separation of the two swing path arms must be increased to 7 inches (17.8 cm). However, if only the first swing path arm is moved, then the ball will no longer be positioned in the centre of the swing path—it will be positioned 1 inch (2.5 cm) from the second swing path arm and 3 inches (7.6 cm) from the first swing path arm. Therefore, in order to maintain the ball in a central position when adjusting the tolerance of an incorrect swing path, swing path arms must be moved. However, if the second swing path arm is to be moved, then this will also adjust the alignment and position of the tail arm and alignment arm and, therefore, the distance between the alignment arm and ball location indicator will be altered to an undesired distance. To prevent this from happening, the second swing path arm is movable along the tail arm. Thus, the separation of the two swing path arms and, therefore, the tolerance of an incorrect swing path, can be adjusted without adjusting the position or alignment of the tail arm and alignment arm. Thus, the separation of the swing path arms can be adjusted whilst maintaining the same distance between the first end of the tail arm, the ball location indicator (when one is used) and the alignment arm.

Preferably, the alignment arm is rotatable about the tail arm such that the tail arm and alignment arm can be positioned to lie alongside one another. This enables efficient storage of the device.

Preferably, the contact means of at least one of the first and second swing path arms is detachable and re-attachable to its swing path arm. Preferably, the golf training device additionally comprises a putting rail engageable with at least one of the first and second swing path arms. Preferably the putting rail comprises a substantially rigid elongate arm engageable with a swing path arm. Preferably the putting rail arm is linear. Preferably, the putting rail arm resists deformation when in conventional use pressure is exerted upon it by a player by way of the shaft of a golf club. Preferably the putting rail is adapted such that when engaged with a swing path arm it extends along the length of the swing path arm.

It is generally accepted that in an ideal putting setup, the eyes of a player should be directly over the ball or just slightly inside—this has led to the use of putting mirrors which are placed on the ground surrounding the in-use sides and rear of a golf ball and which allow a player to determine the position of their eyes relative to the ball without impeding the passage of the ball when putting. Other putting plane aids are well known in the art.

However, the lie angle (defined as the angle between the shaft of the golf club and the ground) of putters varies—some are very upright (have a high lie angle) and in-use the putter head is close to the feet, whereas others are less upright, have a lower lie angle and in-use the putter head is further away from the feet. In addition, golfers come in many different body shapes and sizes and this can also affect the in-use lie angle of putters.

Thus, putting mirrors are not suitable for all putters or players. The provision of a putting rail seeks to overcome this disadvantage. In-use, with the putting rail attached to/engaged with a swing path arm, a player can run their putter back and forth along the rail with the putter shaft either contacting the rail or held slightly away from it. This use of the putting rail allows the player to get used to making an "on plane" stroke, and with practice and use this can help improve their putting as an "on plane" stroke becomes their norm.

Preferably when the putting rail is engaged with a swing path arm the angle defined between the putting rail and the vertical is adjustable. This allows the putting rail and swing path arm combination to accommodate the many different variables mentioned above including the player's personal style, body shape and size, and the lie angle of the putter.

Putting mirrors are still suitable for many players and so in certain embodiments, a putting mirror is also provided to further assist in practicing putting.

In a second aspect of the present invention, there is provided a method for a golfer to perform a practice golf swing with a golf club using a golf training device, said golf training device comprising:

a tail arm having first and second ends;

a first swing path arm;

a second swing path arm which is attachable to and detachable from said tail arm; and an alignment arm extending from said tail arm, that indicates an in-use position for the feet of said golfer relative to said first end of said tail arm during the performance of a golf swing, wherein the distance between the alignment arm and said first end of said tail arm is adjustable;

said alignment arm being pivoted to said tail arm and both said first swing path arm and said second swing path arm having extending from them contact means, said method comprising the steps of:

arranging said golf training device for the golf swing to be practiced;

performing said practice golf swing with said golf club; and determining whether said desired swing path was executed or not by noting the absence or presence respectfully of sensory feedback from said contact means.

Thus, the golf training device used in such a method is preferably a golf training device according to the present invention and in its various embodiments.

Preferably, the golf training device is arranged by performing at least one of:

positioning the first and second swing path arms on a surface so as to define the desired swing path;

placing a golf ball at a desired position along the desired swing path;

adjusting the distance between said alignment arm and said first end of said tail arm such that the alignment arm indicates the desired distance of the golfer's feet from the second swing path arm; and aligning the golfer's feet along the alignment arm.

Thus, in embodiments where the first and second swing path arms are flexible and the tail arm is telescopic, the golf training device is preferably arranged by performing at least one of:

adjusting the curvature of the first and second flexible swing path arms according to the type of said golf club;

positioning the first and second flexible swing path arms on a surface so as to define the desired swing path;

placing a golf ball at a desired position along the desired swing path;

adjusting the extension of the telescopic tail arm such that the alignment arm indicates the desired distance of the golfer's feet from the second swing path arm; and aligning the golfer's feet along the alignment arm.

Preferably, the method additionally comprises the step of rotating the alignment arm in a plane defined by the tail arm and the second swing path arm. Thus, the alignment arm indicates the desired alignment of the golfer's feet relative to the desired swing path according to the type of golf swing to be practiced.

In embodiments having telescopic tail arms, the method preferably additionally comprises the step of rotating the alignment arm about the second end of the telescopic tail arm. Thus, the alignment arm indicates the desired alignment of the golfer's feet relative to the desired swing path according to the type of golf swing to be practiced.

Preferably, the method comprises the step of adjusting the separation of the swing path arms according to a desired level of tolerance of the desired swing path. Preferably, said adjustment of the separation of the swing path arms is achieved by both moving the first swing path arm and by moving the second swing path arm along the tail arm such that the distance between the ball and the alignment arm is maintained throughout.

Preferably, the alignment arm comprises calibration means, the golfer's feet being positioned with reference to the calibration means such that a desired separation of the golfer's feet is achieved.

Preferably, the method comprises the step of rotating the second swing path arm about the first end of the tail arm such that the desired angle of the golfer's feet relative to the desired swing path is indicated according to the practice golf swing to be executed. Thus, the method of the present invention can be used to practice fade and draw shots.

Preferably, the device is fixed to a surface.

Preferably, the device is fixed to a surface by inserting an at least one peg through an at least one hole defined in at least one of the first and second swing path arms, the tail arm and the alignment arm. More preferably, the peg is a golf tee. Alternatively, the peg can be a driving range tee.

Preferably, the ball is positioned along the desired swing path according to the type of the golf club.

Preferably, the method comprises rotating the ball location indicator relative to the first or second swing path arm according to the calibration means and positioning the ball along the swing path at the position indicated by the calibration means.

Preferably, the method comprises aligning the golf club head with the golf club head alignment indicator during the performance of the golf swing.

Preferably, the method comprises rotating the target pointer in a plane defined by the tail arm, ball location indicator and swing path arms so that the target indicator indicates the direction towards a desired target. The alignment of the other features of the device can then be carried out relative to this target pointer.

Preferably, the method comprises moving the second swing path arm laterally relative to the tail arm according to the type of practice golf swing to be executed.

BRIEF DESCRIPTION OF THE DRAWINGS

The invention will be more clearly understood from the following description with reference to the accompanying drawings which show, by way of example only, forms of golf training device and methods of performing a practice golf swing. Of the figures.

Figure 1:
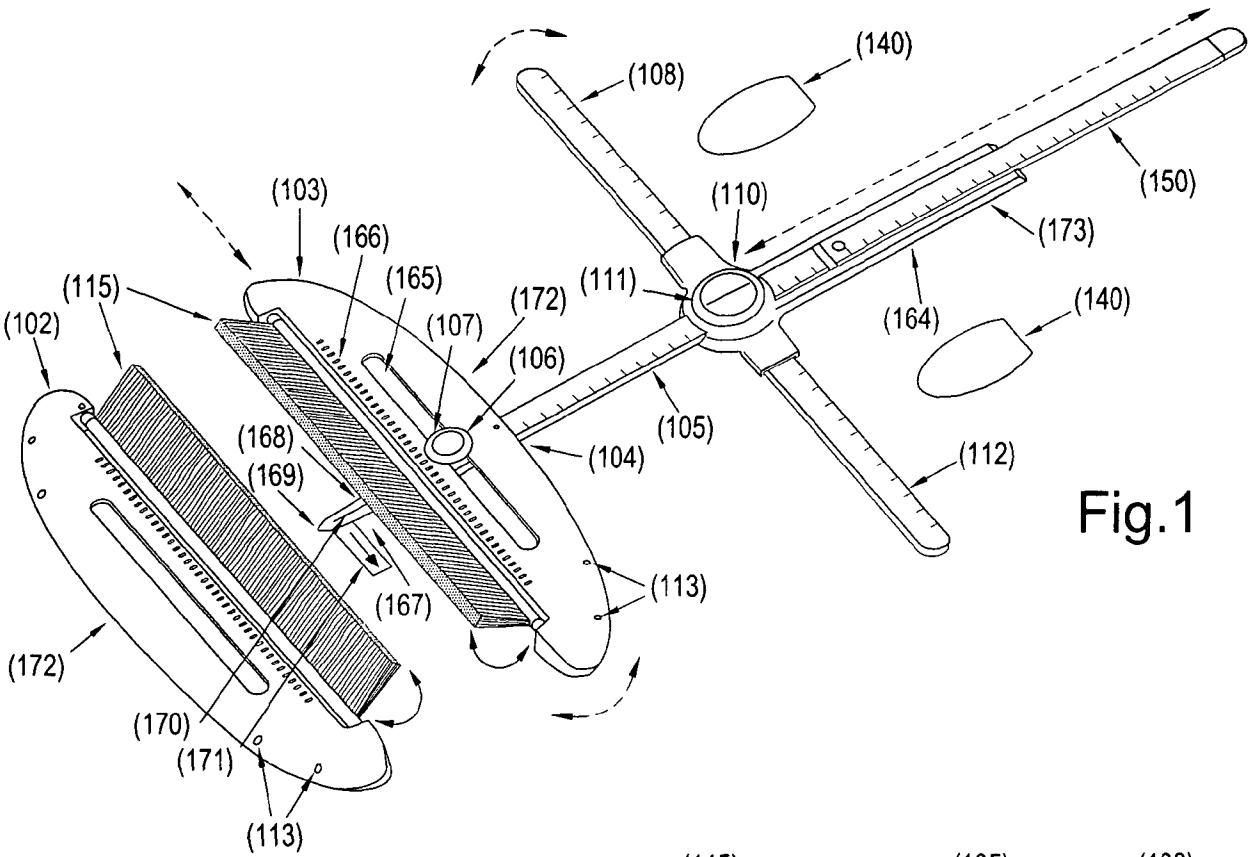
FIG. 1 is a perspective view of a device of certain embodiments of the invention.

A summary of reference signs used herein is provided immediately prior to the claims.

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

Figure 2:
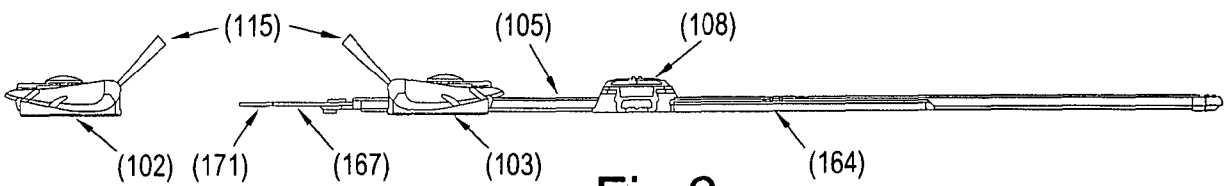
FIG. 2 is a side view of a device of certain embodiments of the invention.

Referring to FIGS. 1 and 2, a golf training device (101) comprises first swing path arm (102) and second swing path arm (103) which is pivotally connected to first end (104) of tail arm (105) via swivel hinge (106). Calibration means (107) on swivel hinge (106) indicates the angle between tail arm (105) and second swing path arm (103). Alignment arm (108) is pivotally connected to tail arm (105) via swivel hinge (110) which has calibration means (111) which shows the angle defined between tail arm (105) and alignment arm (108). Alignment arm (108) is provided with calibration means (112) along its length with a distance scale. Tail arm (105) is provided with calibration means (150) along its length with a distance scale. Tail arm (105) comprises a sheath portion (164) which "sheaths" tail arm (105). Sheath portion (164) is provided with calibration means (173) along its length with a distance scale. Second swing path arm (103) comprises a slot (165), which allows second swing path arm (103) to move laterally relative to tail arm (105). Calibration means (166) show the extent of lateral movement of second swing path arm (103) relative to tail arm (105). Ball location indicator (167), having a first end (168) and second end (169), is pivotally attached to second swing path arm (103) via first end (168). Ball location indicator (167) comprises golf club head alignment indicator (170). Target pointer (171) is pivotally attached to second end (169). First swing path arm (102) and second swing path arm (103) comprise handles (172)

In use, tail arm (105) sits in a generally flat plane and second swing path arm (103), alignment arm (108), ball location indicator (167) and target pointer (171) are all rotatable in that plane. Second swing path arm (103) is rotatable about first end (104) of tail arm (105).

First and second swing path arms (102, 103) define holes (113).

First and second swing path arms (102, 103) are movable independently of one another, and have extending from them contact means in the form of flexible bristles (115). The angle between bristles (115) and the vertical is adjustable.

In use, the separation of first and second flexible swing path arms (102, 103) can be adjusted to be larger or smaller so as to allow a greater or lesser tolerance respectively of an incorrectly performed swing path. This enables device (101) to be used by the less or more experienced golfer respectively. Second flexible swing path arm (103) is movable along tail arm (105) such that, in use, the separation of first and second flexible swing path arms (102, 103) can be adjusted whilst maintaining the distance between the alignment arm and the ball.

Sheath portion (164) allows alignment arm (108) to slide along tail arm (103) so that the distance between swing path arms (102, 103) and alignment arm (108) can be varied. This enables device (101) to be used by taller or shorter golfers using all types of club. For example, a tall golfer using a "driver" will require a larger separation between the flexible swing path arms (102, 103) and alignment arm (108) than a shorter golfer using an "iron".

The separation of alignment arm (108) and second swing path arm (103) can be set by a golfer holding a chosen club so that it is extended directly forwards from the body, the head resting on the ground or just above the ground at a height at which it will in-use hit a ball. This indicates a mid-stroke position for the club head and thus can be used to set the separation of alignment arm (108) and second swing path arm (103), taking into account of course the distance that is desired between the second flexible swing path arm (103) and the mid-stroke position (i.e. the tolerance that is to be allowed). The first flexible swing path arm (102) can then also be positioned. Alternatively, the separation of alignment arm (108) and second swing path arm (103) can be set according to calibration means (150). Alternatively, if, for example, calibration means (150) relates to the height of the golfer, and calibration means (173) relates to the type of club used, then the separation of alignment arm (108) and second swing path arm (103) can be set according to both the height of the golfer and the type of club to be used.

Calibration means (112) on alignment arm (108) allows the golfer's feet (140) to be positioned at a chosen location. For example, when practising a "drive", the golfer's feet (140) require a larger separation, whereas when practising a "putt", a narrower separation of the golfer's feet (140) is required.

Calibration means (111) on swivel hinge (110) allow a chosen angle to be employed between alignment arm (108) and telescopic tail arm (105). For example, when performing a straight shot, the angle should be approximately 90 degrees, whereas when performing a chip shot, a more "open" angle should be employed.

Calibration means (107) on swivel hinge (106) allow a chosen angle to be employed between first and second swing path arms (102, 103) and tail arm (105). This is useful when using device (101) to practice fades and draws (see below).

When a golfer practising with device (110) executes an incorrect swing path, the golf club head will make contact with bristles (115) on first and/or second swing path arms (102, 103). The bristles (115) will provide sensory feedback—the golfer will be able to feel and hear that an incorrect swing path was performed. Bristles (115) are soft and flexible enough so that they do not cause damage to the golfer or the golf club when contact is made.

Figure 3:
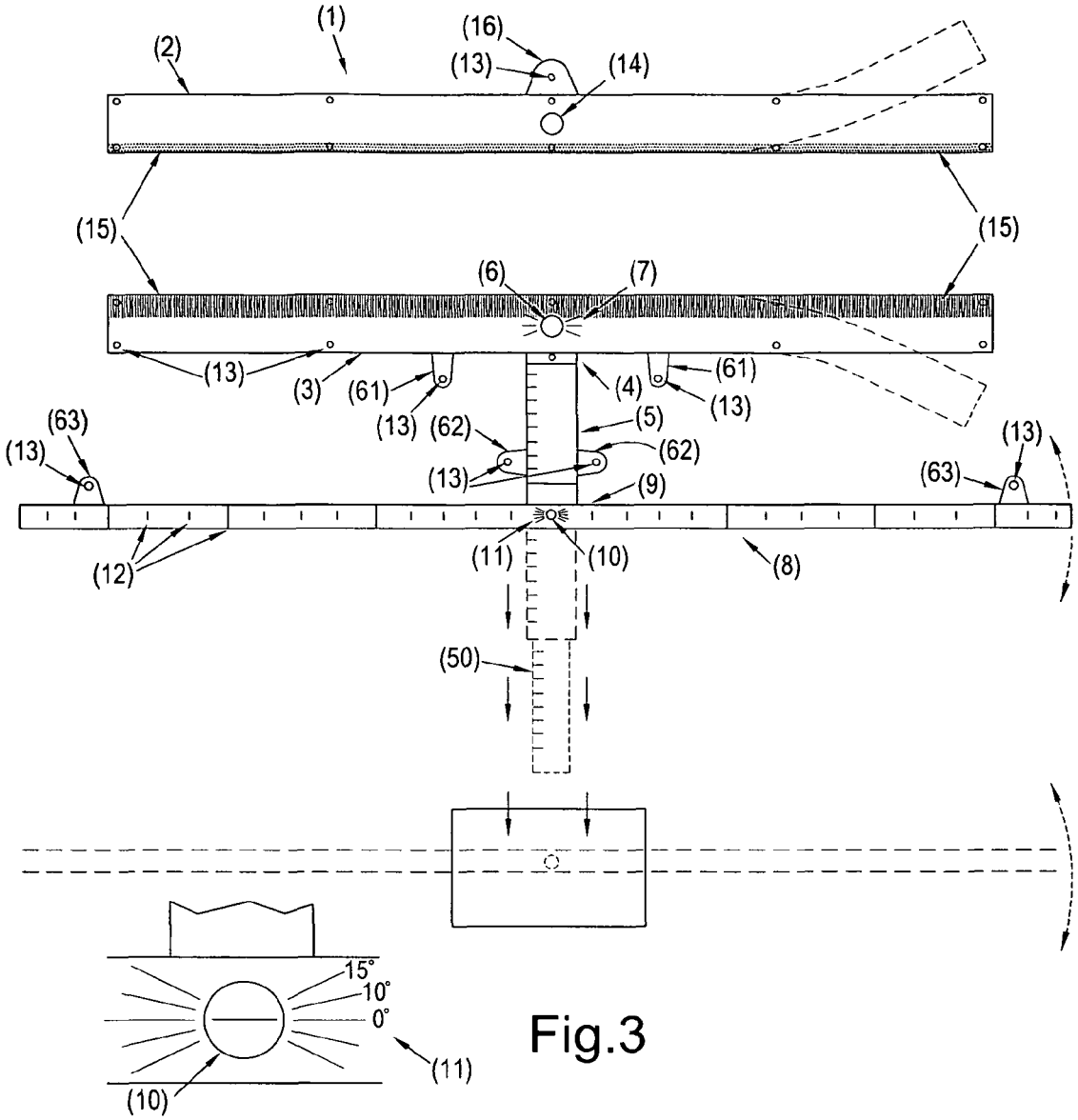
FIG. 3 is a plan view of a device of certain embodiments of the invention.
Figure 4:
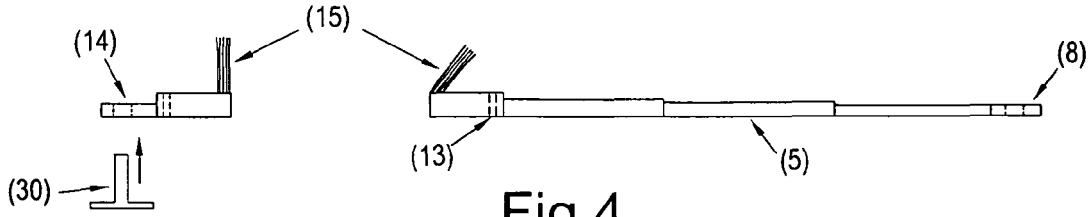
FIG. 4 is a side view of a device of certain embodiments of the invention.

FIGS. 3 and 4 relate to a device of certain other embodiments of the invention, wherein the swing path arms are flexible and the tail arm is telescopic. Referring to FIGS. 3 and 4, a golf training device (1) comprises first flexible swing path arm (2) and second flexible swing path arm (3) which is pivotally connected to first end (4) of telescopic tail arm (5) via swivel hinge (6). Calibration means (7) on swivel hinge (6) indicates the angle between telescopic tail arm (5) and second flexible swing path arm (3). Alignment arm (8) is pivotally connected to second end (9) of telescopic tail arm (5) via swivel hinge (10) which has calibration means (11) which shows the angle defined between telescopic tail arm (5) and alignment arm (8). Alignment arm (8) is provided with calibration means (12) along its length with a distance scale. Telescopic tail arm (5) is provided with calibration means (50) along its length with a distance scale.

In use, telescopic tail arm (5) sits in a generally flat plane and second flexible swing path arm (3) and alignment arm (8) are rotatable in that plane. Second flexible swing path arm (3) is rotatable about first end (4) of telescopic tail arm (5), and alignment arm (8) is rotatable about second end (9) of telescopic tail arm (5).

First and second flexible swing path arms (2, 3) are fabricated from strips of plastic with a wire interior so that, in use, they can be flexed to the required curvature and will retain their shape. First and second flexible swing path arms (2, 3) define holes (13). First flexible swing path arm (2) contains diaphragm hole (14). First flexible swing path arm (2), second flexible swing path arm (3), telescopic tail arm (5) and alignment arm (8) are shaped with wings (60), (61), (62) and (63) extending from them respectfully. Wings (60), (61), (62) and (63) define holes (13) in them.

First and second flexible swing path arms (2, 3) are movable independently of one another, and have extending from them flexible bristles (15).

Figure 5:
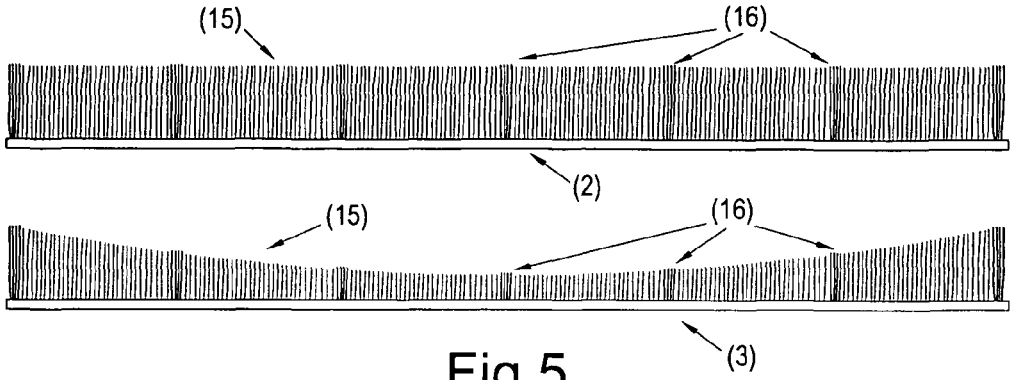
FIG. 5 is a front view of the first and second flexible swing path arms of a device of certain embodiments of the invention, wherein the contact means is comprised of a plurality of bristles.
Figure 6:
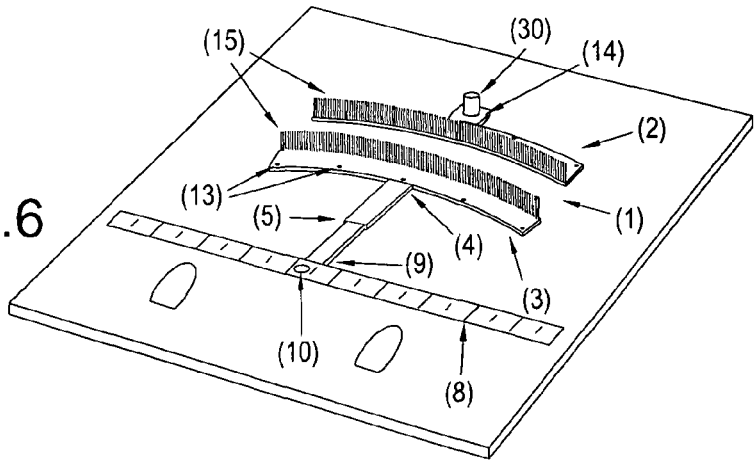
FIG. 6 is a perspective view of a device of certain embodiments of the invention secured to a driving range mat.
Figure 7:
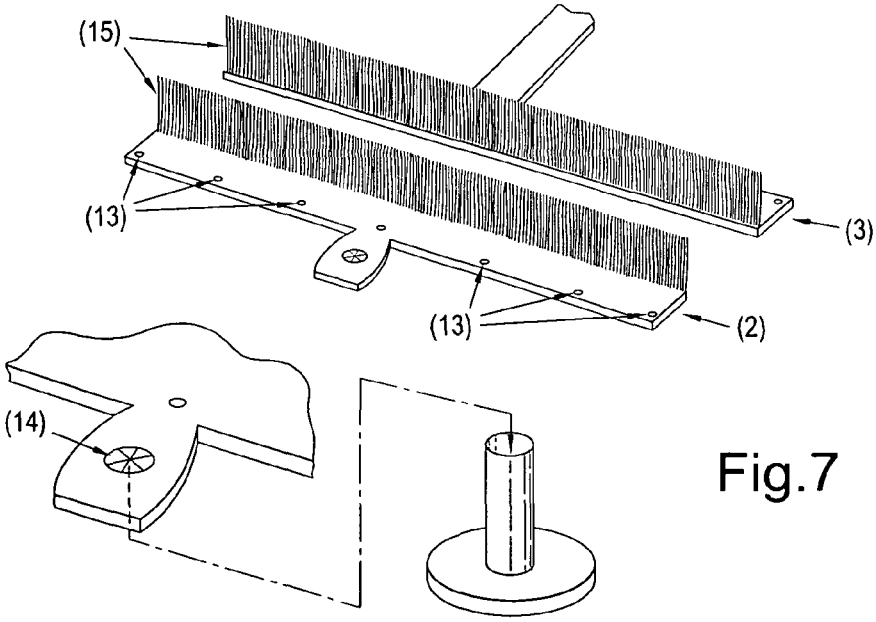
FIG. 7 is a perspective view of the diaphragm hole of a device of certain embodiments of the invention for attachment to a driving range mat.

With reference to FIG. 5, when viewed side on along the longitudinal axis, bristles (15) of second flexible swing path arms (3) define a range of bristle lengths, longest at the outermost portions of the second flexible swing path arm (3) and shortest at the centre portions of the second flexible swing path arm (3), i.e. a vertical curve. Bristles (15) on second flexible swing path arm (3) are angled from the vertical.

In use, device (1) is placed on a fairway (or other suitable surface) and is fixed in position by inserting suitably sized pegs such as golf tees through holes (13) on first and second flexible swing path arms (2, 3), telescopic tail arm (5) and alignment arm (8). If device (1) is used on a driving range, a driving range tee (30) is inserted through diaphragm hole (14) on first flexible swing path arm (2). This is illustrated in FIGS. 2, 4 and 5.

In use, the separation of first and second flexible swing path arms (2, 3) can be adjusted to be larger or smaller so as to allow a greater or lesser tolerance respectively of an incorrectly performed swing path. This enables device (1) to be used by the less or more experienced golfer respectively. The curvature of first and second flexible swing path arms (2, 3) is adjustable so as to change the desired golf swing path as defined between them. This enables device (1) to be used for practising shots using different sizes and types of club.

Telescopic tail arm (5) can be extended to various lengths so that the distance between swing path arms (2, 3) and alignment arm (8) can be varied. This enables device (1) to be used by taller or shorter golfers using all types of club. For example, a tall golfer using a "driver" will require a larger separation between the flexible swing path arms (2, 3) and alignment arm (8) than a shorter golfer using an "iron".

Length of the telescopic tail arm (5) can be set by a golfer holding a chosen club so that it is extended directly forwards from the body, the head resting on the ground or just above the ground at a height at which it will in-use hit a ball. This indicates a mid-stroke position for the club head and thus can be used to set the length of the telescopic tail arm (5), taking into account of course the distance that is desired between the second flexible swing path arm (3) and the mid-stroke position (i.e. the tolerance that is to be allowed). The first flexible swing path arm (2) can then also be positioned. Alternatively, the length of telescopic tail arm (5) can be set according to calibration means (50).

Curvature of the first and second flexible swing path arms (2, 3) can then be determined by the golfer moving the club forwards (31) and backwards (32) in the swing from the mid-position. Thus, an indication of the appropriate curvature is obtained and the first and second flexible swing path arms (2, 3) can be shaped appropriately.

Calibration means (12) on alignment arm (8) allows the golfer's feet (40) to be positioned at a chosen location. For example, when practising a "drive", the golfer's feet (40) require a larger separation, whereas when practising a "putt", a narrower separation of the golfer's feet (40) is required.

Calibration means (11) on swivel hinge (10) allow a chosen angle to be employed between alignment arm (8) and telescopic tail arm (5). For example, when performing a straight shot, the angle should be approximately 90 degrees, whereas when performing a chip shot, a more "open" angle should be employed.

Calibration means (7) on swivel hinge (6) allow a chosen angle to be employed between first and second flexible swing path arms (2, 3) and telescopic tail arm (5). This is useful when using device (1) to practice fades and draws (see below).

Markings (16) on bristles (15) allow the ball to be positioned at a chosen location along the length of the desired swing path, according to the type of club used and type of shot to be performed. For example, when executing a shot using an "iron" club, the ball should be placed in the centre of the swing path, whereas in contrast, when executing a shot using a "driver" club, the ball should be placed further along the swing path.

When a golfer practising with device (1) executes an incorrect swing path, the golf club head will make contact with bristles (15) on first and/or second flexible swing path arms (2, 3). The bristles (15) will provide sensory feedback—the golfer will be able to feel and hear that an incorrect swing path was performed. Bristles (15) are soft and flexible enough so that they do not cause damage to the golfer or the golf club when contact is made.

Figure 8:
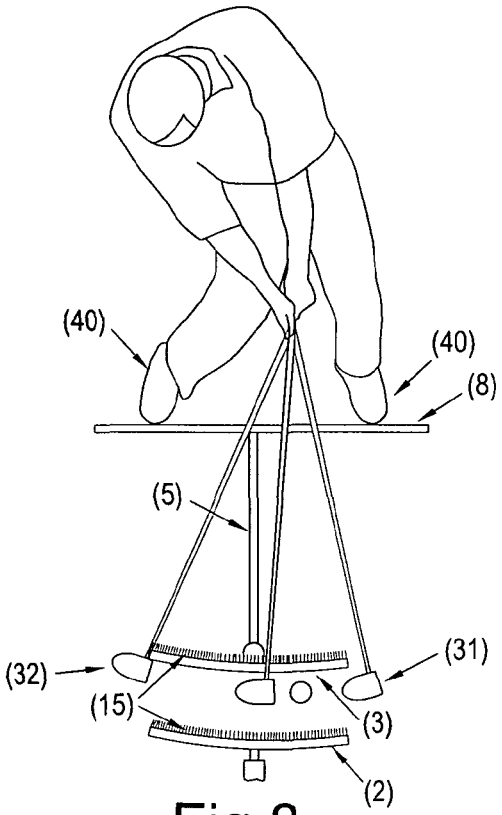
FIG. 8 is a plan view of a device of certain embodiments of the invention when used with a "driver" club.

FIG. 8 shows device (1) when used with a "driver" club. Golf shots using such a club require a more curved swing path. This is achieved by flexing first (2) and second (3) flexible swing path arms to a desired curvature. Golf shots using such a club also require the golfer to employ a wider stance. Calibration means (12) on alignment arm (8) allow the golfer's feet to be positioned at a chosen location. Telescopic tail arm (5) is used to vary the distance between the golfer's feet and the ball. Calibration means (50) allow a chosen distance between the golfer's feet and the ball to be employed. This enables device (1) to be used by different sized golfers using a variety of both different sizes and different types of club. In this case, a "driver" is a large club meaning that telescopic tail arm (5) is extended to increase the distance between the golfer's feet and the ball to ensure that the golfer employs a correct stance whilst executing the shot. Shots using a "driver" require the ball to be placed further along the swing path. The markings (16) on bristles (15) allow the ball to be placed at a chosen position along the length of the swing path.

Figure 9:
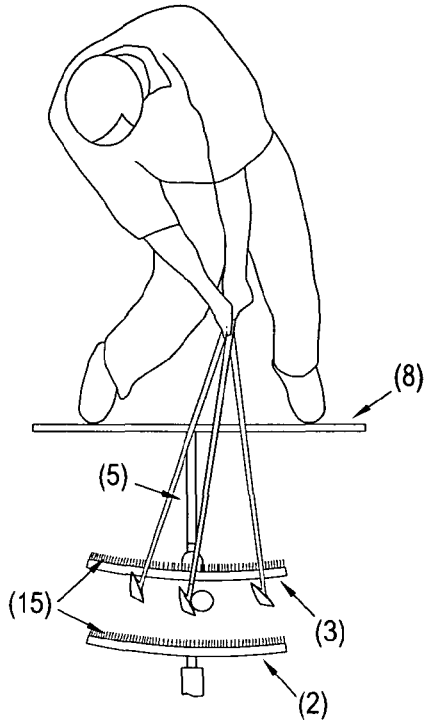
FIG. 9 is a plan view of a device of certain embodiments of the invention when used with an "iron" club.

FIG. 9 shows device (1) when used with an "iron" club. Shots using this type of club require a slightly less-curved swing path and require the golfer's feet (40) to be nearer the ball during the performance of the shot, as compared to when a "driver" is used. Altering the curvature of flexible swing path arms (2, 3) and decreasing the extension of telescopic tail arm (5) can account for this. In contrast to a shot using a "driver" club, a shot using an "iron" club requires the ball to be placed at the middle of the swing path.

Figure 10:
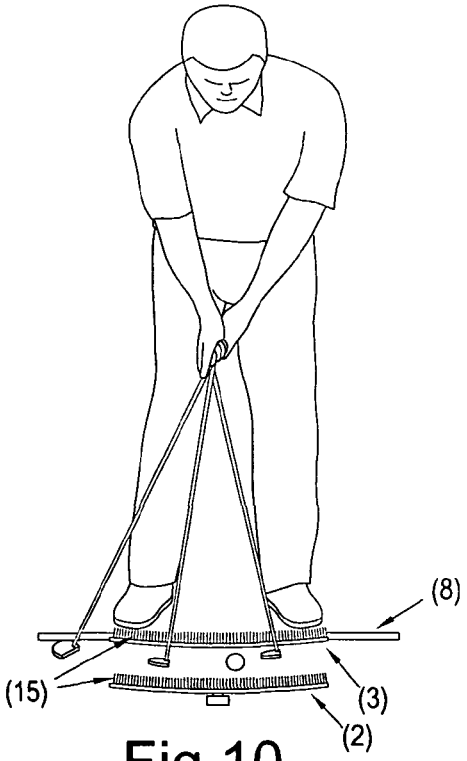
FIG. 10 is an end view of a device of certain embodiments of the invention when used with a "putter" club.

FIG. 10 shows device (1) when used with a "putter" club. Shots using this type of club require an even less-curved swing path and require the golfer's feet (40) to be even nearer to the ball during the performance of the shot, as compared to when a "driver" is used. Altering the curvature of flexible swing path arms (2, 3) and decreasing the extension of telescopic tail arm (5) can account for this. Again, in contrast to a shot using a "driver" club, a shot using a "putter" club requires the ball to be placed at the middle of the swing path.

Figure 11:
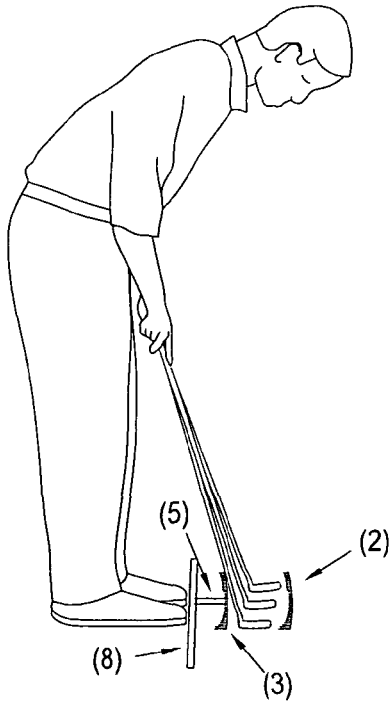
FIG. 11 is a side view of a device of certain embodiments of the invention when used with a "putter" club.

FIG. 11 shows device (1) when using a "putter" club as viewed from the side.

Figure 12:
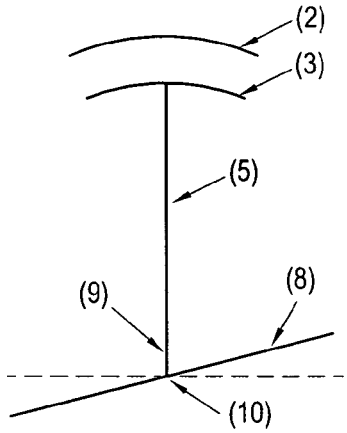
FIG. 12 is a schematic of the arrangement of a device of certain embodiments of the invention when used to practice a chipping shot.

FIG. 12 shows a schematic of the arrangement of device (1) when used for the performance of a "chip" shot. This type of shot requires a slightly "open" stance. Therefore, when performing a shot with swing path from right to left, alignment arm (8) is rotated slightly anticlockwise (as viewed from above) around second end (9) of telescopic tail arm (5) via hinge (10). Calibration means (11) allow a chosen angle to be employed.

Figure 13:
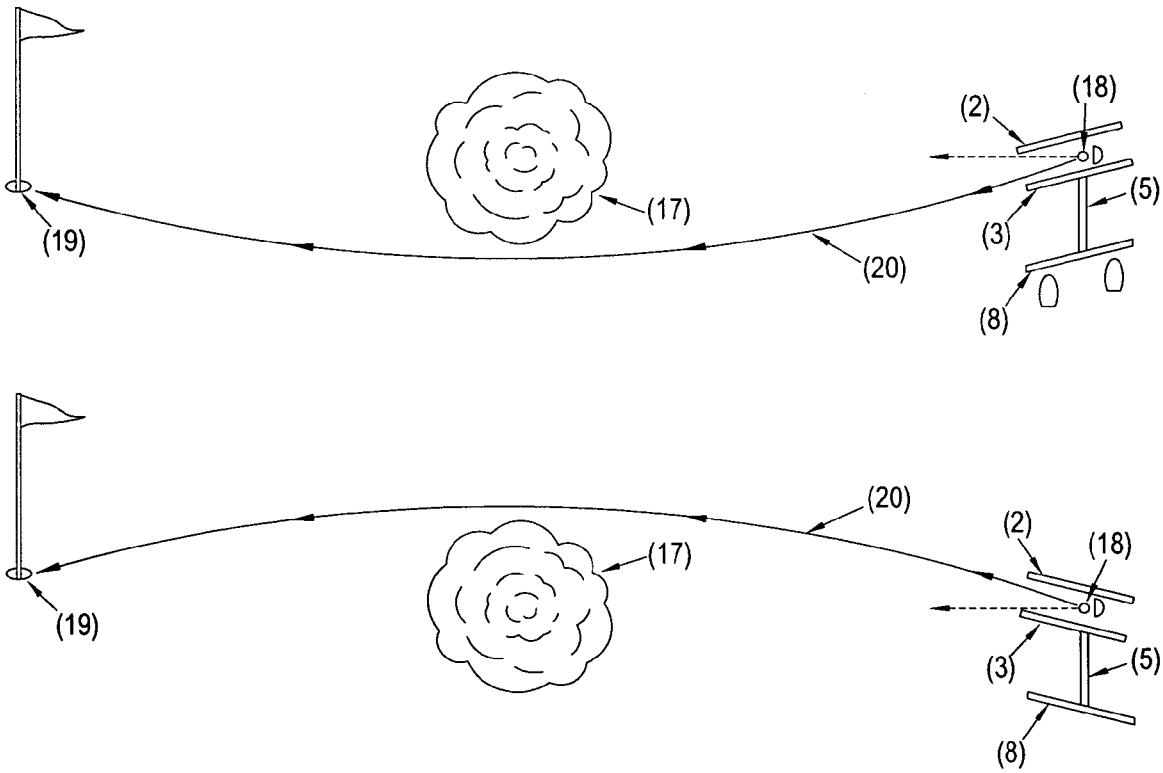
FIG. 13 is a schematic of the arrangement of a device of certain embodiments of the invention when used to practice fade and draw shots.

FIG. 13 is a schematic of the arrangement of device (1) when used to practice fade shots (top) and draw shots (bottom). An object (17) is situated between ball (18) and target (19). Flexible swing path arms (2, 3) and alignment arm (8) are angled to the left of object (17) (for the fade) or the right of object (17) (for the draw). Telescopic tail arm (5) is kept perpendicular to the target so that the face of the golf club can be correctly aligned so as to provide the desired level of spin on ball (18) when ball (18) is struck. This enables ball path (20) to achieve the desired level of curvature so that ball (18) is directed towards target (19) whilst avoiding object (18).

Figure 14:
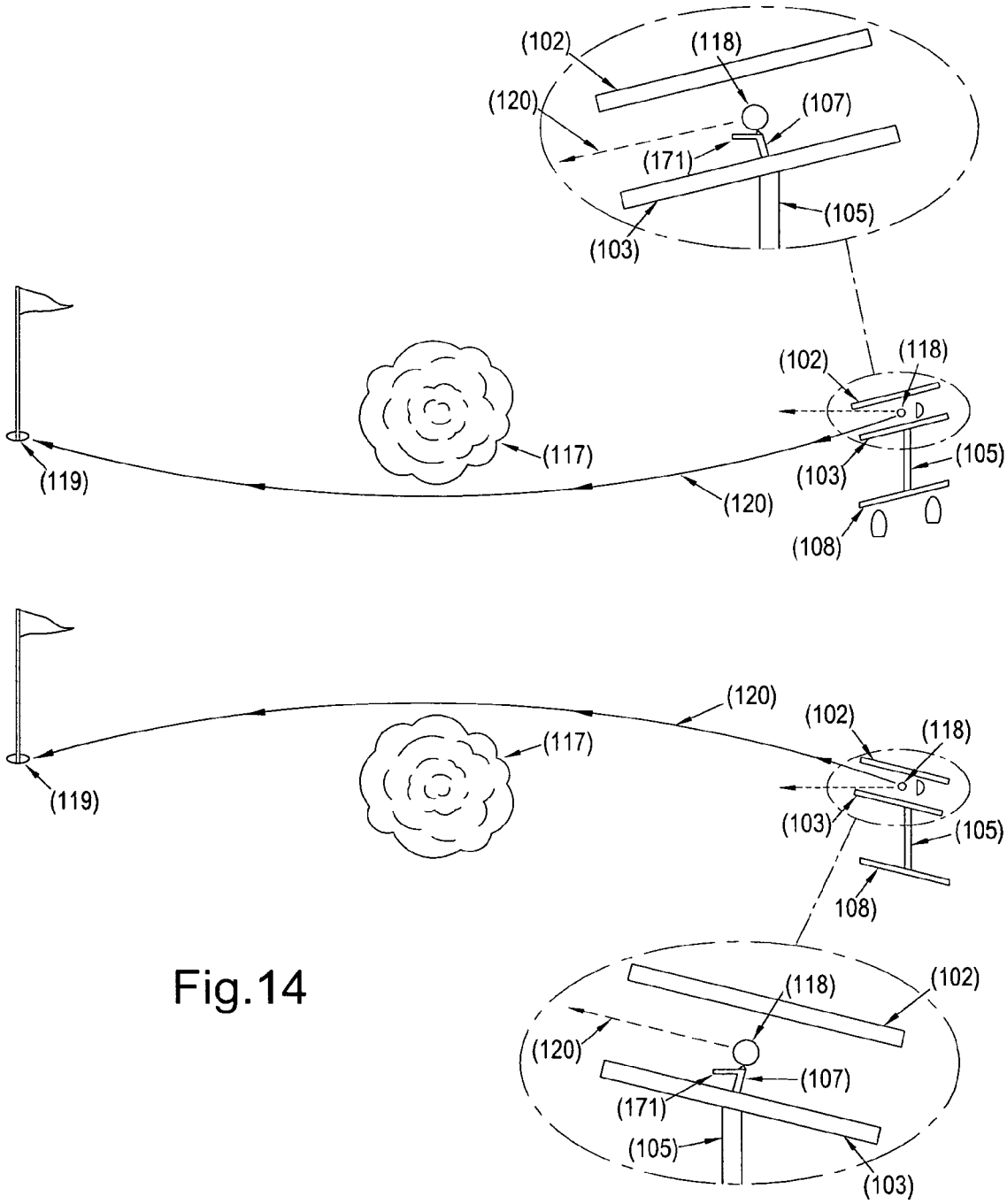
FIG. 14 is a schematic of the arrangement of a device of certain embodiments of the invention when used to practice fade and draw shots.

FIG. 14 is a schematic of the arrangement of device (101) when used to practice fade shots (top) and draw shots (bottom). Two "zoomed-in" portions of the schematic are also provided. An object (117) is situated between ball (118) and target (119). Swing path arms (102, 103) and alignment arm (108) are angled to the left of object (117) (for the fade) or the right of object (117) (for the draw). Ball location indicator (167) indicates where the ball (118) should be placed along the swing path. Target pointer (171) points at the target (119).

Figure 15A:
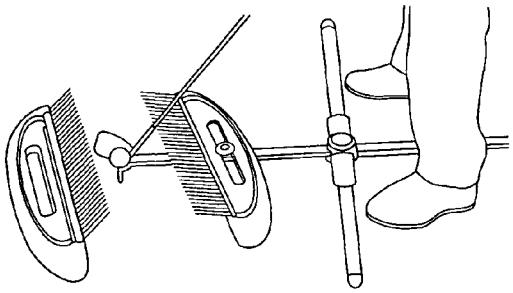
FIGS. 15A, 15B, 15C, and 15D show shows a device according to the present invention set up to perform a variety of shots and drills.
Figure 15B:
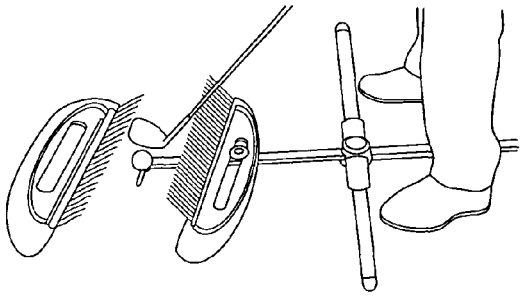
Figure 15C:
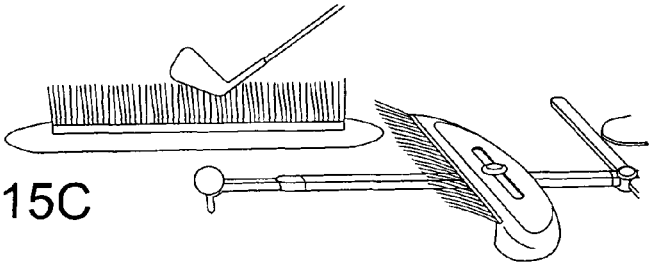
Figure 15D:
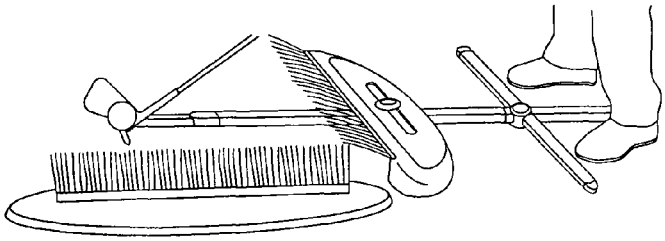

FIGS. 15A, 15B, 15C, and 15D show a device according to the present invention set up to perform a variety of golf shots or practice drills. FIG. 15A shows the device set up to perform a fade shot using an iron club. FIG. 15B shows the device set up to perform a draw shot using an iron club. FIG. 15C shows the device set up to perform the "one piece takeaway" drill. FIG. 15D shows the device set up to 25 perform a drill to ensure the correct level of "extension"

Figure 16:
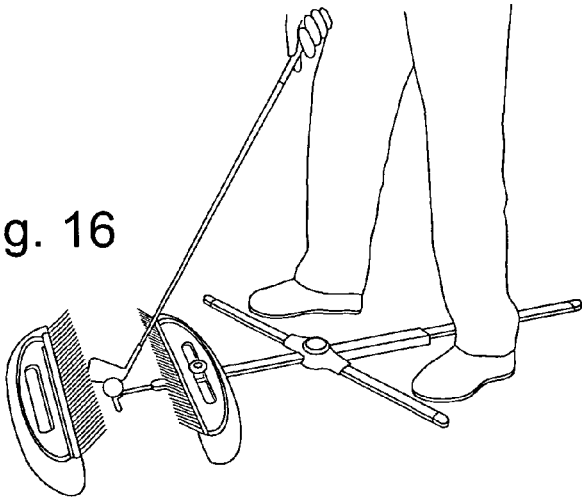
FIG. 16 shows a device according to the present invention set up to perform an "anti reverse pivot drill"

FIG. 16. shows device according to the present invention set up to perform an "anti reverse pivot drill". In this case, the alignment arm is rotated about the tail arm to indicate the desired position of the golfer's feet when he draws back his leading foot in line with the heal of his rear foot.

Figure 17:
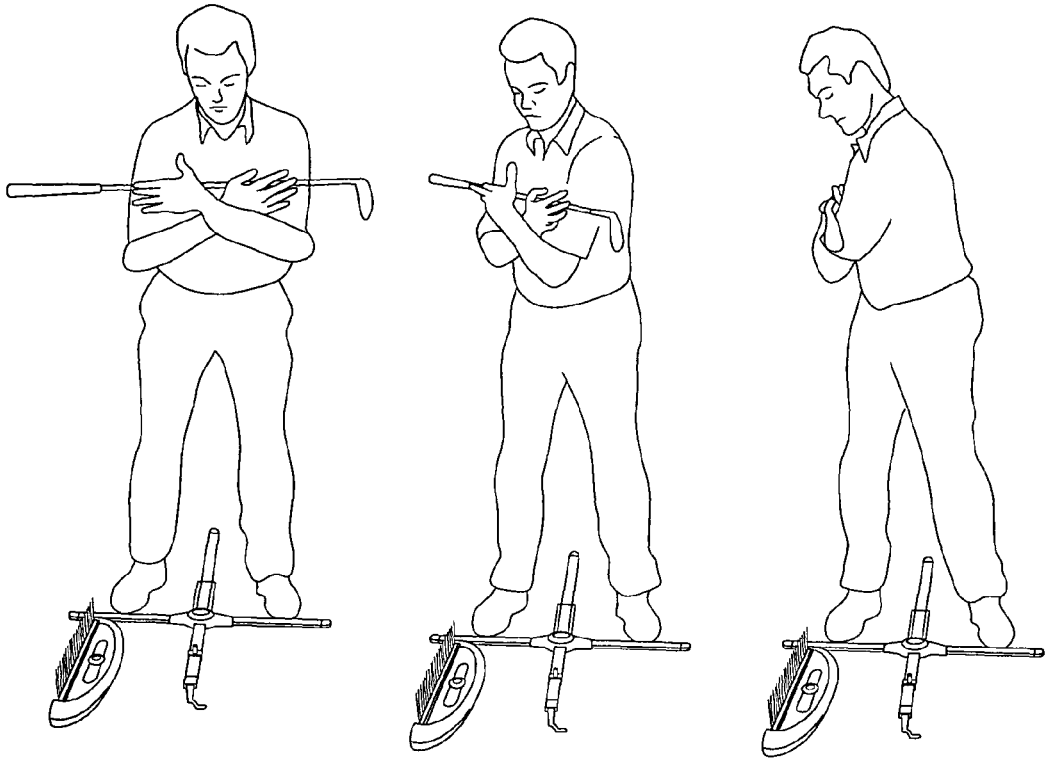
FIG. 17 shows a device according to the present invention set up to perform a "body rotation"

FIG. 17 shows a device according to the present invention set up to perform a body rotation.

Figure 18:
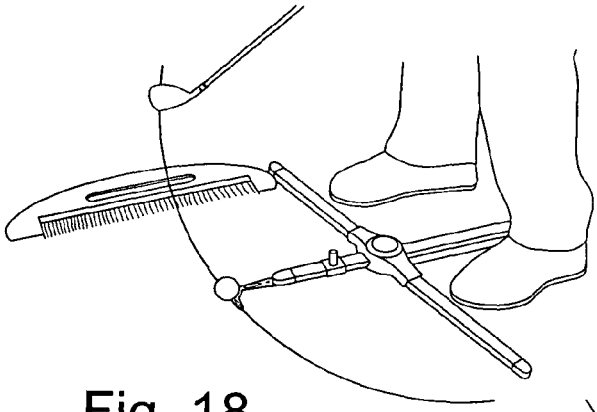
FIG. 18 shows the mechanics of a chip shot (chipping—hit down on ball)

FIG. 18 shows the mechanics of a chip shot. When performing a chip shot, the golfer aims to hit down on the ball.

Figure 19:
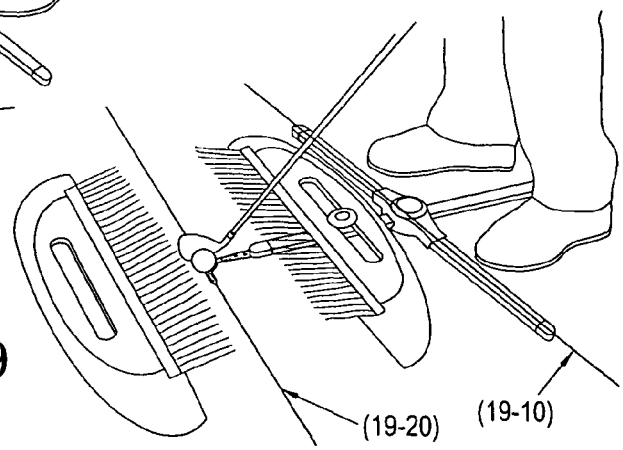
FIG. 19 shows a device according to the present invention set up to perform a chip shot (chipping)

FIG. 19 shows a device according to the present invention set up to perform a chip shot. 19-10 indicates alignment; 19-20 indicates swing path. In this case, the alignment arm is rotated relative to the tail arm in order to indicate the desired stance.

Figure 20:
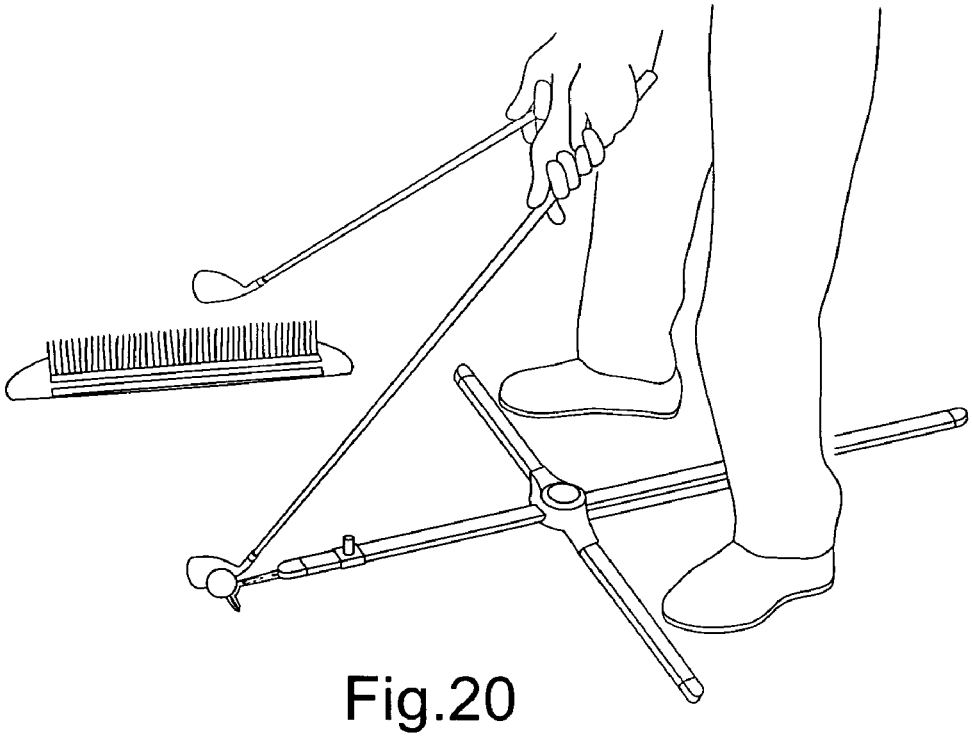
FIG. 20 shows a device according to the present invention set up to perform the compression drill.

FIG. 20 shows a device according to the present invention set up to perform the compression drill.

Figure 21:
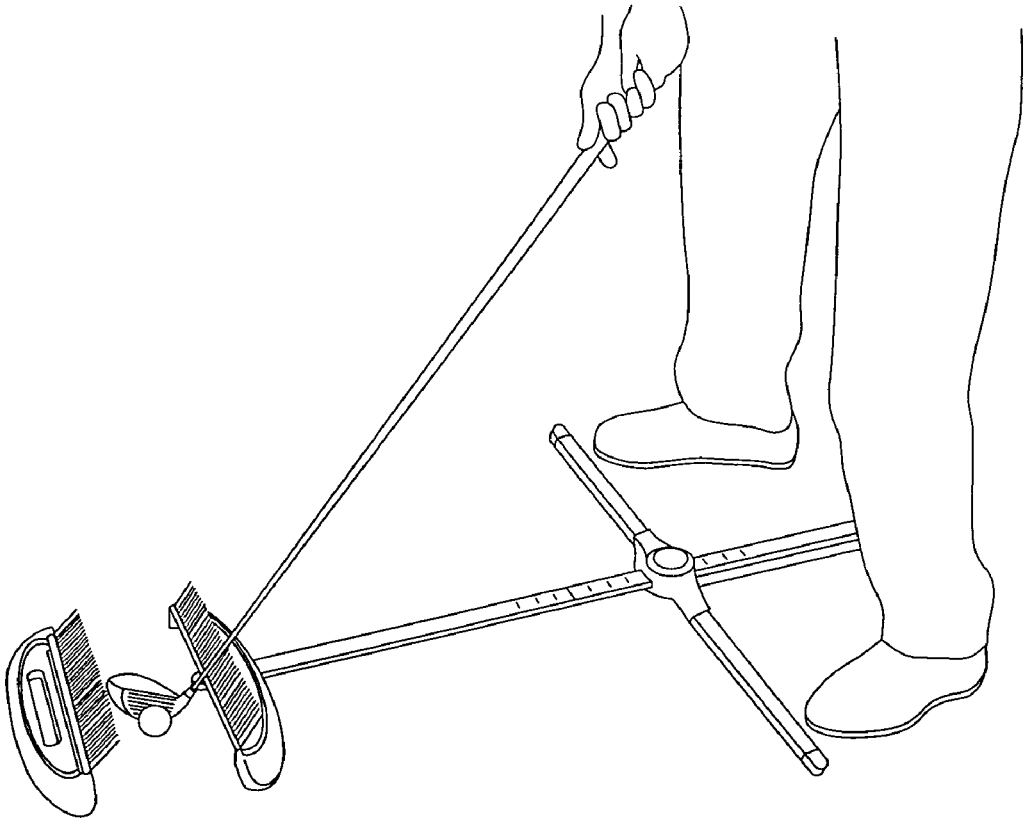
FIG. 21 shows a device according to the present invention set up for correct alignment when using a driver (driver alignment)

FIG. 21 shows a device according to the present invention set up for correct alignment when using a driver.

Figure 22:
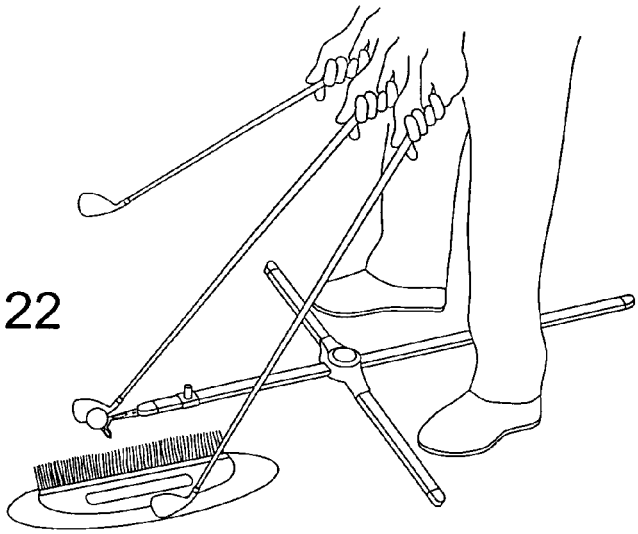
FIG. 22 shows a device according to the present invention set up to perform the "extension drill"

FIG. 22 shows a device according to the present invention set up to perform the "extension drill". In this case, the second swing path arm is detached from the tail arm and is positioned parallel to the tail arm. The second swing path arm is positioned at a desired position further along the swing path than the point at which the ball is struck. When contact is made between the golf club head and the contact means, the golfer knows that the correct level of "extension" is achieved.

Figure 23:
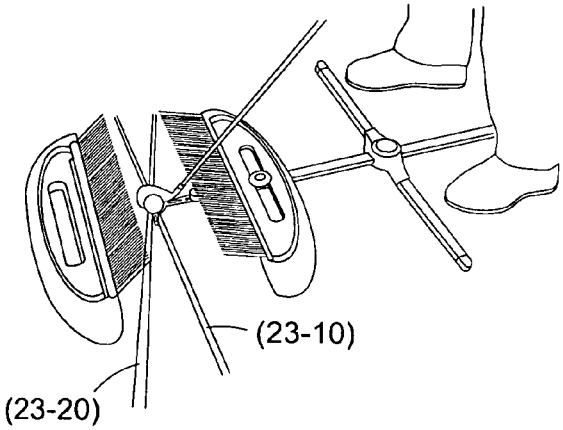
FIG. 23 shows a device according to the present invention set up to perform a fade shot.

FIG. 23 shows a device according to the present invention set up to perform a fade shot. 23-10 indicates swing path. 23-20 indicates club face angle line. The club face angle line is perpendicular to the golf club face. It can be seen that when performing a fade shot, the club face angle line is at an angle to the swing path.

Figure 24:
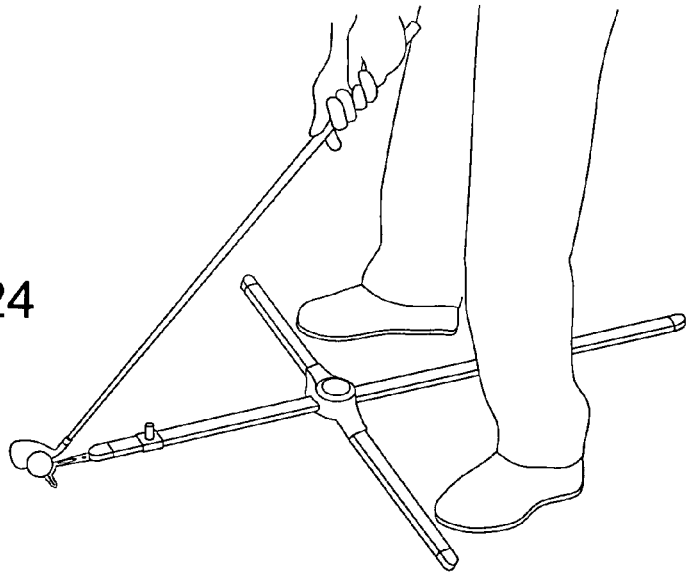
FIG. 24 shows a device according to the present invention set up to practice correct alignment (just alignment)

FIG. 24 shows a device according to the present invention set up to practice correct alignment. In this case, the second swing path arm is detached from the tail arm and the device is set up to practice alignment on its own without practicing a correct swing path.

Figure 25:
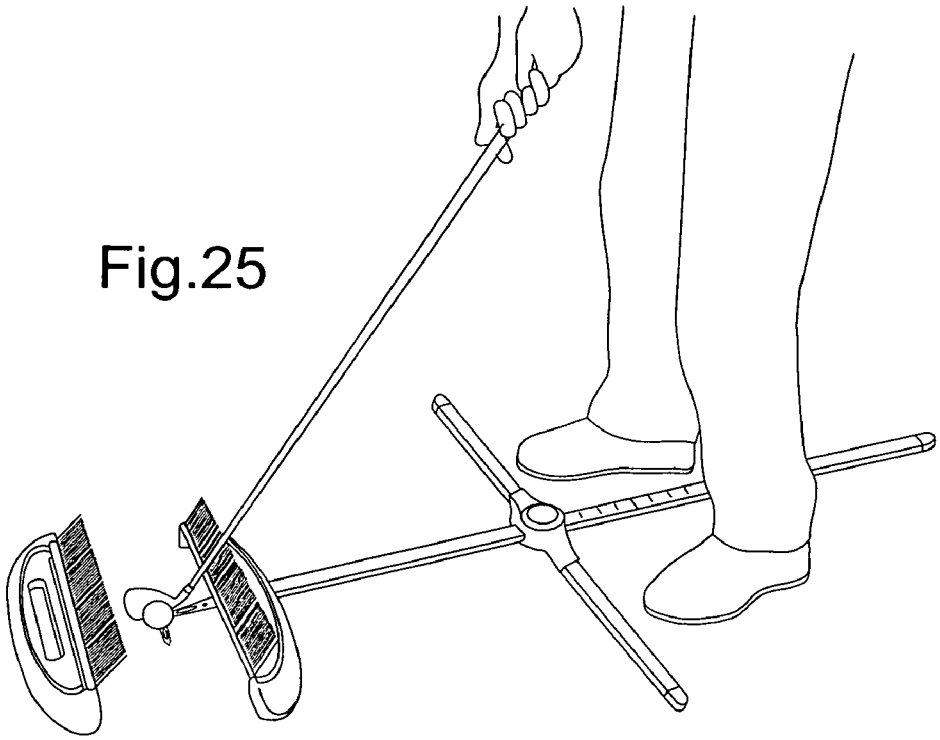
FIG. 25 shows a device according to the present invention set up to practice alignment using a mid-iron.

FIG. 25 shows a device according to the present invention set up to practice alignment using a mid-iron.

Figure 26:
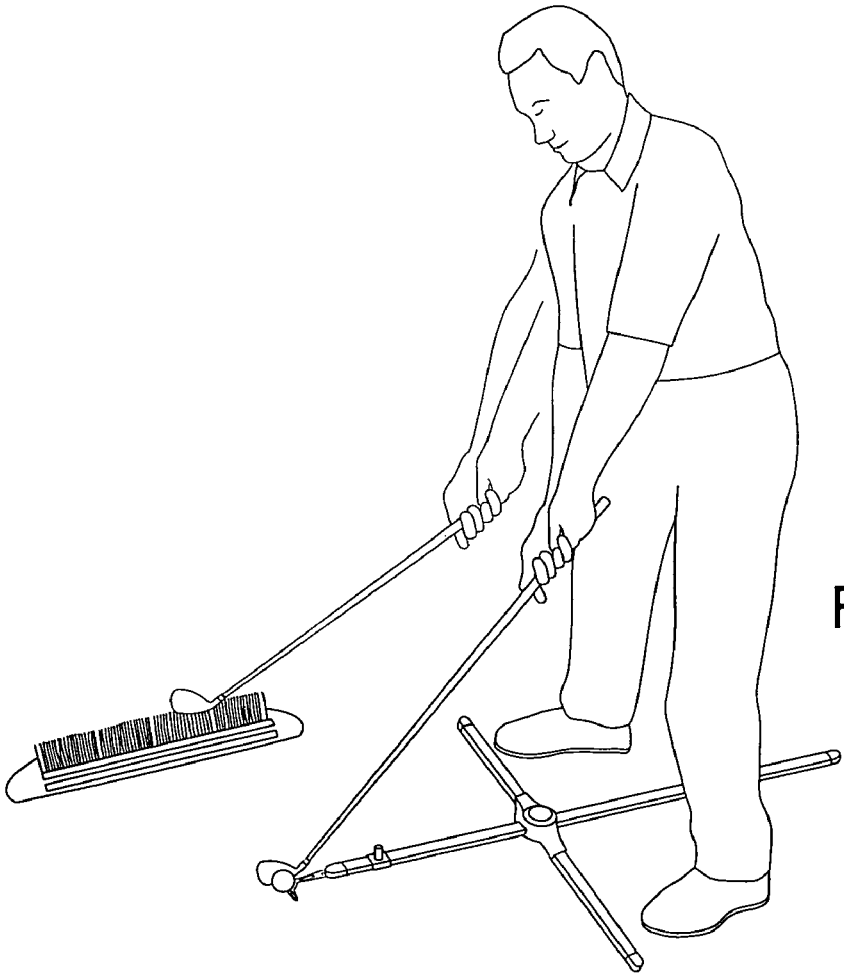
FIG. 26 shows a device according to the present invention set up to perform the "one piece take away" drill.

FIG. 26 shows a device according to the present invention set up to perform the "one piece take away" drill. In this case, the second swing path arm is detached from the tail arm and is placed parallel to the tail arm. The second swing path arm is placed at a desired position along the back swing part of the swing path. When the golf club head makes contact with the contact means, the golfer knows that he is maintaining his arms at the correct distance from his body.

Figure 27:
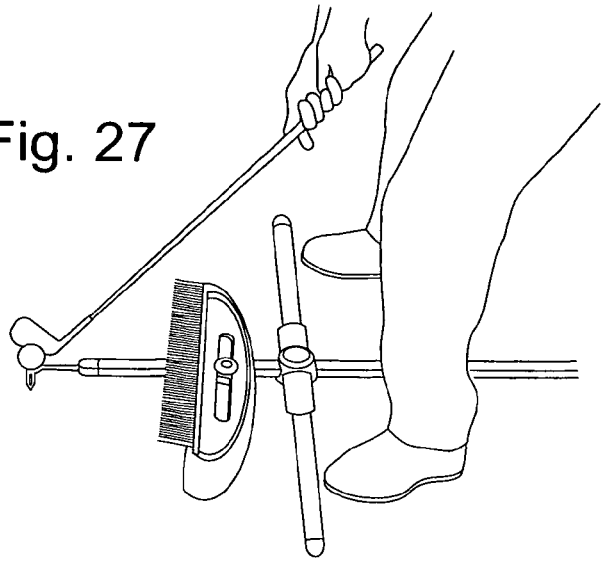
FIG. 27 shows a device according to the present invention set up to perform the pre-set drill.

FIG. 27 shows a device according to the present invention set up to perform the pre-set drill.

Figure 28:
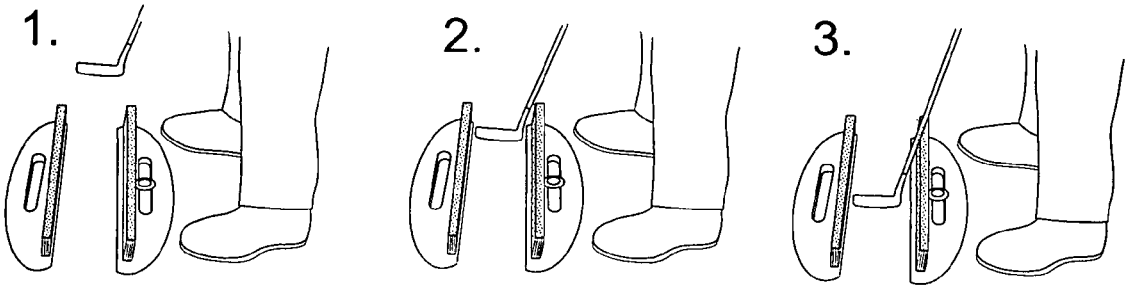
FIG. 28 shows a device according to the present invention set up to practice correct putting line.

FIG. 28 shows a device according to the present invention set up to practice correct putting line. In this case, the second swing path arm is detached from the tail arm and only the two sing path arms are used.

Figure 29:
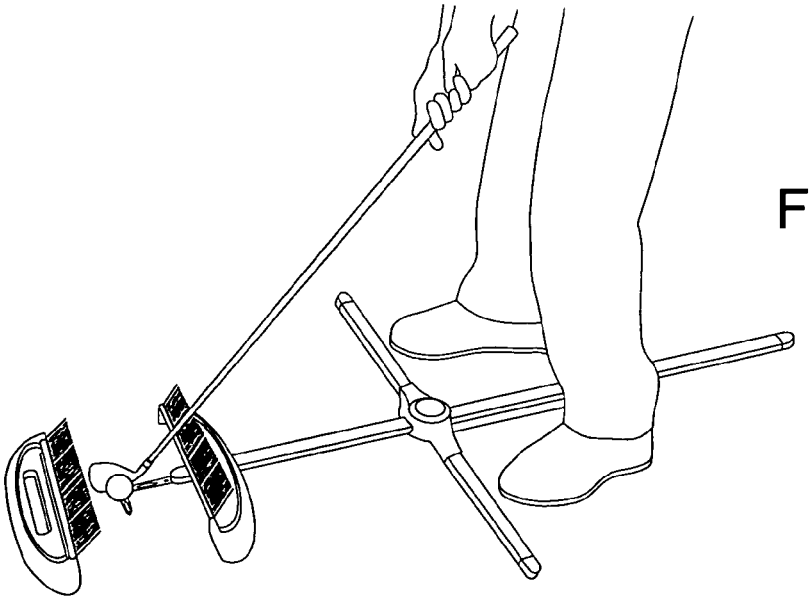
FIG. 29 shows a device according to the present invention set up to practice correct short iron alignment.

FIG. 29 shows a device according to the present invention set up to practice correct short iron alignment.

Figure 30:
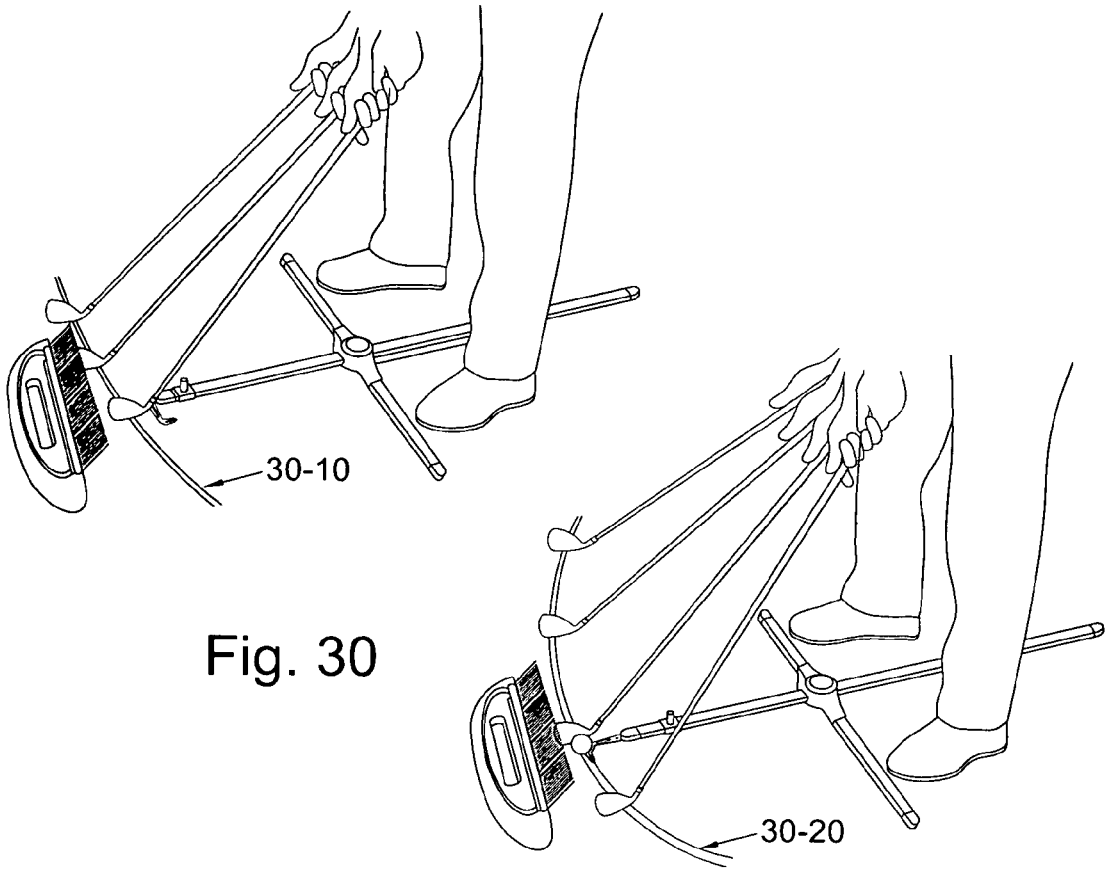
FIG. 30 shows (top) the swing path when an incorrect slice is performed and (bottom) the swing path when the slice has been corrected. 30-10 and 30-20 indicate swing path.

FIG. 30 shows the swing path when a slice is performed (top) and when the slice has been corrected (bottom).

Figure 31:
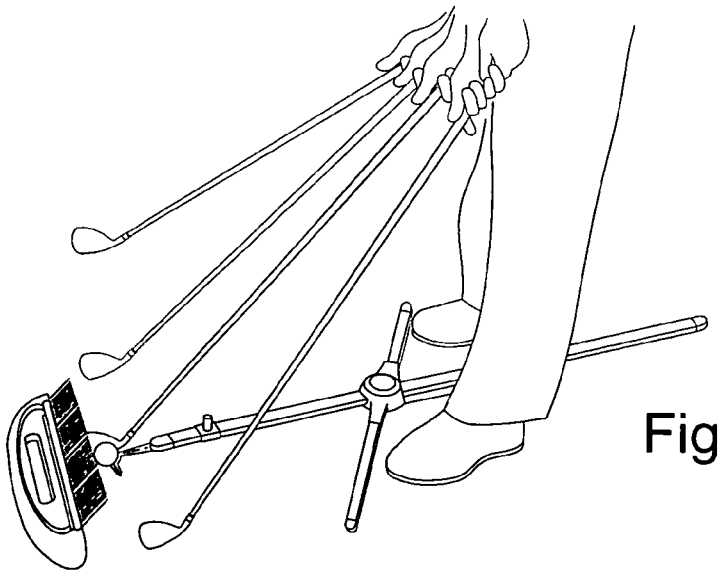
FIG. 31 shows a device according to the present invention set up to perform the slice correction drill.

FIG. 31 shows a device according to the present invention set up to perform the slice correction drill.

Figure 32:
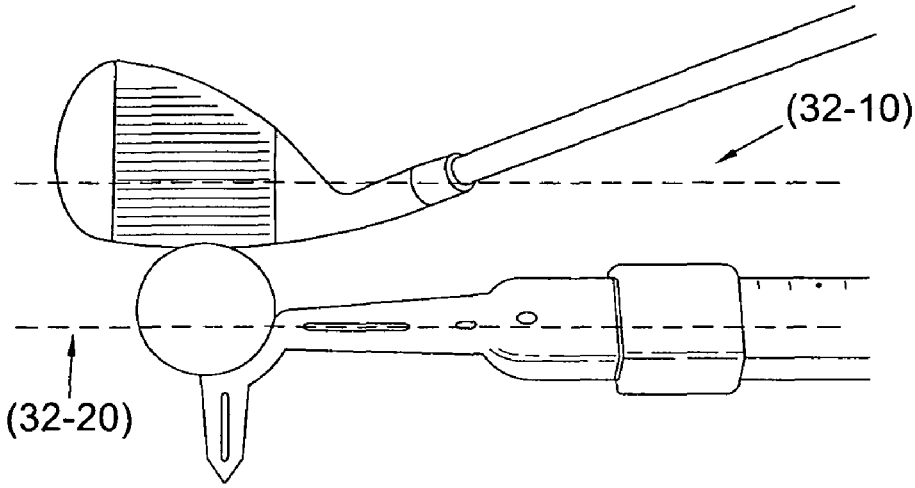
FIG. 32 shows part of a device according to the present invention which indicates how the golf club head should be aligned with the golf club head alignment indicator (square club address)

FIG. 32 shows part of a device according to the present invention which indicates how the golf club head should be aligned with the golf club head alignment indicator. 32-10 is club head alignment axis. 32-20 is axis indicated by club head alignment indicator. Specifically, it can be seen that the club head alignment axis should be aligned with the axis indicated by the club head alignment indicator i.e. they should be parallel to each other.

Figure 33:
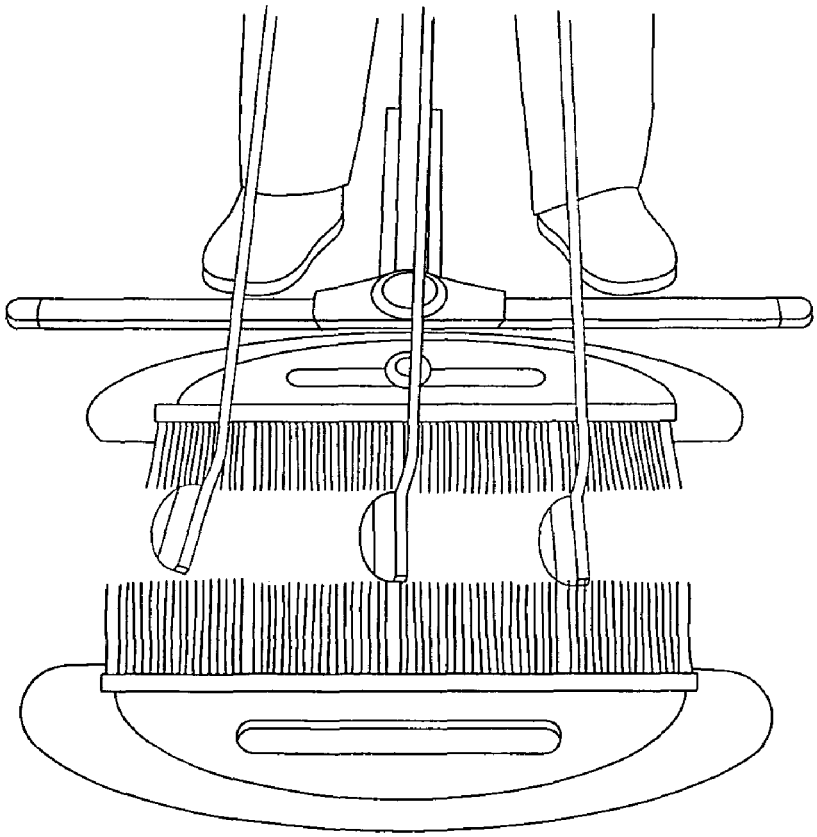
FIG. 33 shows a device according to the present invention set up to perform the tick-tock putting drill.

FIG. 33 shows a device according to the present invention set up to perform the tick-tock putting drill.

Figure 34:
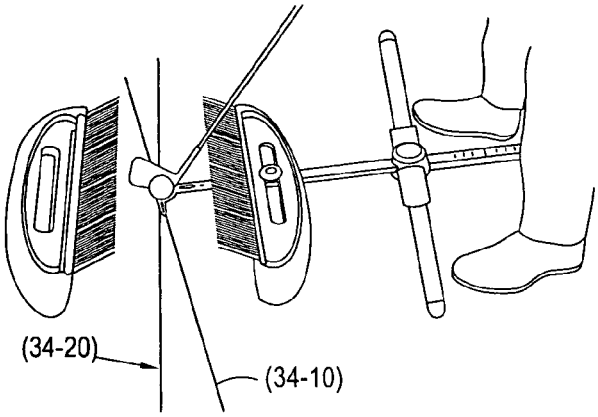
FIG. 34 shows a device according to the present invention set up to perform a draw.

FIG. 34 shows a device according to the present invention set up to perform a draw. 34-10 is club face angle. 34-20 is swing path. The club face angle line is perpendicular to the golf club face. It can be seen that when performing a draw shot, the club face angle line is at an angle to the swing path.

Figure 35:
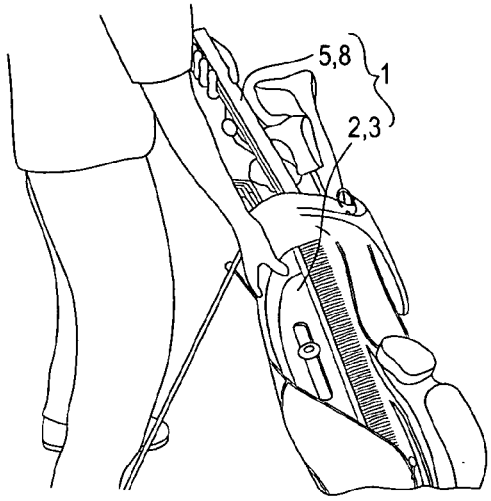
FIG. 35 shows a device according to the present invention when prepared for storage.

FIG. 35 shows a device according to the present invention when prepared for storage. The alignment arm has been rotated so as to lie along the same axis as the tail arm to enable efficient storage. The second swing path arm has been detached from the tail arm to enable efficient storage.

Figure 36:
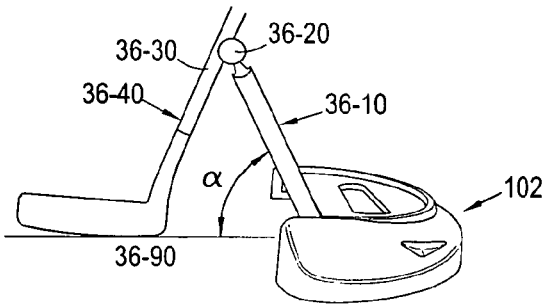
FIGS. 36-38 show a putting rail engaged with a swing path arm.

FIG. 36 shows a swing path arm 102 which has had its contact means in the form of flexible bristles 115 temporarily removed and replaced with putting rail 36-10. As can be seen, the putting rail comprises generally rigid linear elongate putting rail arm 36-20 against which in-use is placed shaft 36-30 of putter 36-40. The angle defined between putting rail 36-10 and the horizontal (floor 36-90) is adjustable and in FIG. 36 the angle between the horizontal and the putting rail (particularly the putting rail arm 36-20) is seen to be angle $\alpha$.

Figure 37:
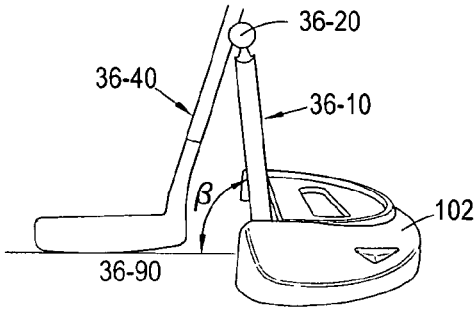

As can be seen from FIG. 37, putter 36-40 is held at a different angle (i.e. has a different lie angle) to that of FIG. 36 and the angle between the horizontal and the putting rail 36-10 (particularly the putting rail arm 36-20) is seen to be angle $\beta$.

Figure 38:
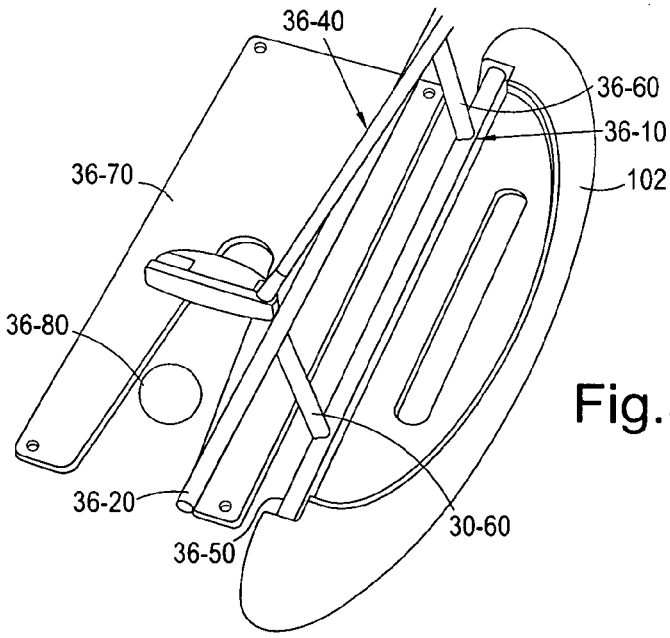

FIG. 38 shows putting rail 36-10 to further comprise second arm 36-50 which is engaged with (and rotatable about) swing path arm 102 and which is joined to putting rail arm 36-20 by way of bars 36-60. The use of putting mirror 36-70 to assist in the putting of ball 36-80 is also shown.

It will be appreciated that the invention is not limited to the above examples only and further variations thereof will be readily apparent to a person of ordinary skill in the art without departing from the scope of the appended claims.

REFERENCE SIGNS

1—golf training device
2—first flexible swing path arm
3—second flexible swing path arm
4—first end of telescopic tail arm
5—telescopic tail arm
6—swivel hinge
7—calibration means
8—alignment arm
9—second end of telescopic tail arm
10—swivel hinge
11—calibration means
12—calibration means
13—hole
14—diaphragm hole
15—flexible bristles
16—markings
17—object
18—ball
19—target
20—ball path
30—driving range tee
31—forwards
32—backwards
40—golfer's feet
50—calibration means
60—wing
61—wing
62—wing
63—wing
101—golf training device
102—first swing path arm
103—second swing path arm
104—first end of tail arm
105—tail arm
106—swivel hinge
107—calibration means
108—alignment arm
110—swivel hinge
111—calibration means
112—calibration means
113—hole
115—flexible bristles
117—object
118—ball
119—target
140—golfer's feet
150—calibration means
164—sheath portion
165—slot
166—calibration means
167—ball location indicator
168—ball location indicator first end
169—ball location indicator second end
170—golf club head alignment indicator
171—target pointer
172—handles
173—calibration means
19-10—alignment
19-20—swing path
23-10—swing path
23-20—club face angle line
32-10—club head alignment axis
32-20—axis indicated by club head alignment indicator
34-10—club face angle
34-20—swing path
36-10—putting rail
36-20—elongate putting rail arm
36-30—shaft
36-40—putter
36-50—second arm
36-60—bars
36-70—putting mirror
36-80—ball

The invention claimed is:

1. A golf training device comprising:

a tail arm having first and second ends;

first and second swing path arms having extending from them contact means comprising a plurality of bristles, which extend out from said first and second swing path arms, said contact means being angled from a vertical direction, and the angle between said contact means and the vertical direction being adjustable; and an alignment arm pivoted to said tail arm, that in-use indicates a position for the feet of a golfer relative to said first end of said tail arm during the performance of a golf swing, wherein the distance between said alignment arm and said first end of said tail arm is adjustable.

2. The golf training device as set forth in claim 1, wherein said first and second swing path arms are flexible such that a curvature of said first and second swing path arms are adjustable, wherein in use said first and second flexible swing path arms can be moulded to a desired curvature and will retain their shape until moulded to a different desired curvature.

3. The golf training device as set forth in claim 1, wherein said alignment arm comprises a sheath portion capable of sheathing said tail arm such that, in use, said alignment arm can be slid along a length of said tail arm so as to render said alignment arm movable along said tail arm between said first and second ends.

4. The golf training device as set forth in claim 1, wherein said second swing path arm defines a slot engageable with said tail arm, said second swing path arm being laterally movable relative to said tail arm.

5. The golf training device as set forth in claim 1, wherein said device comprises at least one ball location indicator, said at least one ball location indicator comprising a first end and a second end and extending at said first end from said first end of said tail arm such that, in use, said second end of said ball location indicator indicates the desired position that a golf ball should be placed before the performance of said golf swing;

wherein said at least one ball location indicator further comprises a golf club head alignment indicator which, in use, indicates the desired alignment of a golf club head relative to a golf ball during the performance of said golf swing.

6. The golf training device as set forth in claim 5, wherein the angle between said ball location indicator and at least one of said first swing path arm and said second swing path arm is adjustable;

wherein said second end of said ball location indicator further comprises a target pointer which, in use, indicates the direction towards a desired target, wherein said target pointer extends from said second end of said ball location indicator, wherein the angle between said ball location indicator and said target pointer is adjustable.

7. The golf training device as set forth in claim 1, wherein said first swing path arm and said second swing path arm are separated from one another and wherein the orientation of the first swing path arm with respect to the second swing path arm is adjustable.

8. The golf training device as set forth in claim 1, wherein the angle between said contact means and the vertical direction can be adjusted between 0-90 or 0-135 degrees.

9. The golf training device as set forth in claim 1, wherein said contact means on said second swing path arm is curved, being shorter towards a middle of said second swing path arm than at the ends, wherein said contact means comprise markings.

10. The golf training device as set forth in claim 1, wherein said first end of said tail arm is pivotally attached to said second swing path arm via a swivel hinge, and wherein said second swing path arm is movable along said tail arm.

11. The golf training device as set forth in claim 1, further comprising attachment means for attachment to a surface, wherein said attachment means comprising an at least one hole defined in at least one of said first and second swing path arms, wherein said at least one hole is dimensioned to allow passage of the body portion of a golf tee comprising a body portion and a ball supporting portion.

12. The golf training device as set forth in claim 1, further comprising calibration means arranged to measure the angle defined between said alignment arm and said tail arm; and further comprising additional calibration means arranged to measure the distance between said first end of said tail arm and said alignment arm.

13. The golf training device as set forth in claim 1, further comprising a putting rail engageable with at least one of the first and second swing path arms.

14. A method for a golfer to perform a practice golf swing with a golf club using a golf training device, comprising:

providing a tail arm having first and second ends;

providing first and second swing path arms having extending from them contact means comprising a plurality of bristles, which extend out from said first and second swing path arms, said contact means being angled from a vertical direction, and the angle between said contact means and the vertical direction being adjustable;

providing an alignment arm pivoted to said tail arm, that in-use indicates a position for the feet of a golfer relative to said first end of said tail arm during a performance of a golf swing, wherein the distance between said alignment arm and said first end of said tail arm is adjustable;

arranging said golf training device for the golf swing to be practiced;

performing said practice golf swing with the golf club; and determining whether or not a desired swing path was executed by noting an absence or a presence respectfully of sensory feedback from said contact means.

15. The method as set forth in claim 14, wherein said arranging step comprising:

positioning said first and second swing path arms on a surface so as to define said desired swing path;

placing a golf ball at a desired position along said desired swing path;

adjusting the distance between said alignment arm and said first end of said tail arm such that said alignment arm indicates the desired distance of said golfer's feet from said second swing path arm; and aligning said golfer's feet along said alignment arm.

16. The method as set forth in claim 14, further comprising the steps of:

providing a ball location indicator;

positioning a golf ball according to a desired position as indicated by said ball location indicator;

providing a golf club head alignment indicator;

aligning a golf club head of the golf club with said golf club head alignment indicator on contact with said golf ball during the performance of said practice golf swing; and providing a target pointer that indicates the direction towards a desired target of a practice golf swing.

17. The method as set forth in claim 14, wherein at least one of said first swing path arm, said second swing path arm, said tail arm, and said alignment arm has a hole defined therein, and further comprising the step of fixing at least one of said first swing path arm, said second swing path arm, said tail arm, and said alignment arm to a surface by inserting a golf tee through said hole and into the surface.

18. A golf training device comprising:

a tail arm having first and second ends;

first and second swing path arms having extending from them a plurality of bristles; and an alignment arm pivoted to said tail arm, that in-use indicates a position for the feet of a golfer relative to said first end of said tail arm during the performance of a golf swing, wherein the distance between said alignment arm and said first end of said tail arm is adjustable.

19. The golf training device as set forth in claim 18, wherein some of the bristles extend from the first swing path arm and wherein some of the bristles extend from the second swing path arm, wherein the bristles are angled from a vertical direction, and wherein the angle between the bristles of the first swing path arm and the vertical is adjustable, and wherein the angle between the bristles of the second swing path arm and the vertical direction is adjustable, and wherein the first swing path arm and the second swing path arm are separated from one another such that a common member does not connect the first swing path arm to the second swing path arm.

20. The golf training device as set forth in claim 18, further comprising:

at least one ball location indicator, said at least one ball location indicator comprising a first end and a second end and extending at said first end from said first end of said tail arm such that, in use, said second end of said ball location indicator indicates the desired position that a golf ball should be placed before a performance of the golf swing;

wherein said at least one ball location indicator has a golf club head alignment indicator which, in use, indicates the desired alignment of a golf club head relative to the placed golf ball during the performance of the golf swing;

wherein said second end of said ball location indicator has a target pointer which, in use, indicates the direction towards a desired target, wherein said target pointer extends from said second end of said ball location indicator.

* * * * *